US010407134B2

(12) United States Patent
Stevens

(10) Patent No.: US 10,407,134 B2
(45) Date of Patent: Sep. 10, 2019

(54) CHAIN FLAKER SYSTEM, TO DISTRIBUTE ANCHOR CHAIN EVENLY IN ANCHOR CHAIN LOCKER

(71) Applicant: Sierra Madre Marine LLC, San Francisco, CA (US)

(72) Inventor: Lee Stevens, San Mateo, CA (US)

( * ) Notice: Subject to any disclaimer, the term of this patent is extended or adjusted under 35 U.S.C. 154(b) by 239 days.

(21) Appl. No.: 15/392,394

(22) Filed: Dec. 28, 2016

(65) Prior Publication Data

US 2017/0183063 A1 Jun. 29, 2017

Related U.S. Application Data

(60) Provisional application No. 62/271,894, filed on Dec. 28, 2015.

(51) Int. Cl.
*B63B 21/04* (2006.01)
*B63B 21/16* (2006.01)

(52) U.S. Cl.
CPC ..... *B63B 21/04* (2013.01); *B63B 21/16* (2013.01)

(58) Field of Classification Search
CPC ..... B63B 21/04; B63B 21/10; B63B 21/16; B63B 21/18; B63B 21/50; B66D 1/72
See application file for complete search history.

(56) References Cited

U.S. PATENT DOCUMENTS 3,222,032 A * 12/1965 Schneider ..... B66F 5/04 254/124

4,778,121 A * 10/1988 Minnee ..... B66D 1/38 242/157.1

(Continued)

FOREIGN PATENT DOCUMENTS

CN 201800875 4/2011
CN 202283975 6/2012

(Continued)

OTHER PUBLICATIONS

Office Action dated Oct. 16, 2017 in Taiwan Patent Application No. 105143729.

(Continued)

*Primary Examiner* — Michael E Gallion
(74) *Attorney, Agent, or Firm* — Vierra Magen Marcus LLP

(57) ABSTRACT

An integrated, electro-mechanical system to distribute anchor chain relatively equally in a yacht's/boat's/ship's anchor chain locker during recovery of the anchor. One embodiment of the Chain Flaker System invention will: (1) fit a Fleming F-78 chain locker and fit other vessels' similar chain lockers with minimal changes; (2) minimally obstruct access into the chain locker; (3) well handle 600' of ½", or more length of, smaller diameter chain in a Fleming F-78 and adapt to handle more, and/or larger diameter, chain and/or other vessels with similar access to, but different sized, chain lockers; (4) be economic, robust, reliable, and easy-to-maintain, including because intentionally simple mechanically (e.g. single hydraulic cylinder or linear servo unit of L-shaped chain distribution model or single hydraulic or electric driver of figure 8 shaped chain distribution model); and (5) be easy and safe to operate as essentially automatic with safety features to minimize risk of injury.

21 Claims, 29 Drawing Sheets

(56) References Cited

U.S. PATENT DOCUMENTS

| | | | | |
|---|---|---|---|---|
| 4,862,821 | A * | 9/1989 | Ballantyne | B66D 1/72 114/293 |
| 5,678,452 | A * | 10/1997 | Frazier | B66D 1/72 254/342 |
| 5,845,893 | A * | 12/1998 | Groves | B63B 21/10 254/389 |
| 8,342,484 | B2 * | 1/2013 | Matos | B66D 1/72 254/371 |
| 9,567,039 | B2 * | 2/2017 | Busson | B63B 21/18 |
| 9,975,606 | B2 * | 5/2018 | Trouve | B63B 21/10 |
| 2002/0084449 | A1 * | 7/2002 | Hovik | B63B 21/18 254/264 |
| 2005/0241558 | A1 * | 11/2005 | Barlow | B63B 21/04 114/200 |
| 2012/0160146 | A1 * | 6/2012 | Miller | B63B 21/10 114/200 |
| 2013/0043447 | A1 * | 2/2013 | Farrell, III | B66D 3/006 254/264 |
| 2014/0339485 | A1 * | 11/2014 | Busson | B63B 21/18 254/389 |
| 2015/0000579 | A1 * | 1/2015 | Pontaut | B63B 21/04 114/230.3 |
| 2015/0014614 | A1 * | 1/2015 | Lisland | B66D 1/72 254/325 |
| 2016/0280333 | A1 * | 9/2016 | Trouve | B63B 21/10 |

FOREIGN PATENT DOCUMENTS

| | | |
|---|---|---|
| CN | 104125914 | 10/2014 |
| JP | 1016877 | 1/1998 |
| JP | 2000108984 | 4/2000 |
| JP | 2005132179 | 5/2005 |

OTHER PUBLICATIONS

English language Abstract for CN104125914 published Oct. 29, 2014.
English language Abstract for CN202283975 published Jun. 27, 2012.
English language Abstract for CN201800875 published Apr. 20, 2011.
English language Abstract for JP2005132179 published May 26, 2005.
English language Abstract for JP2000108984 published Apr. 18, 2000.
English language Abstract for JP1016877 published Jan. 20, 1998.
Response to Office Action filed Apr. 17, 2018 in Taiwan Patent Application No. 105143729.

* cited by examiner

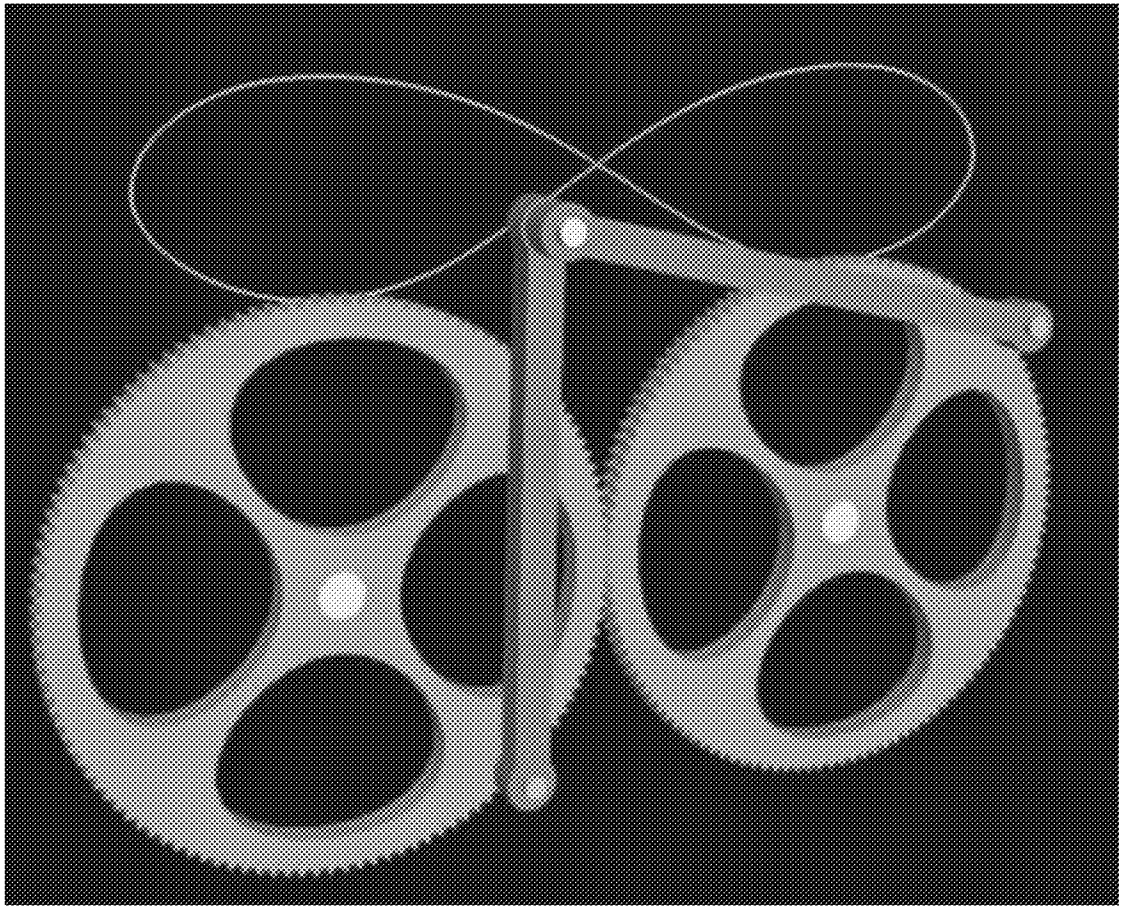
Figure 6Z1

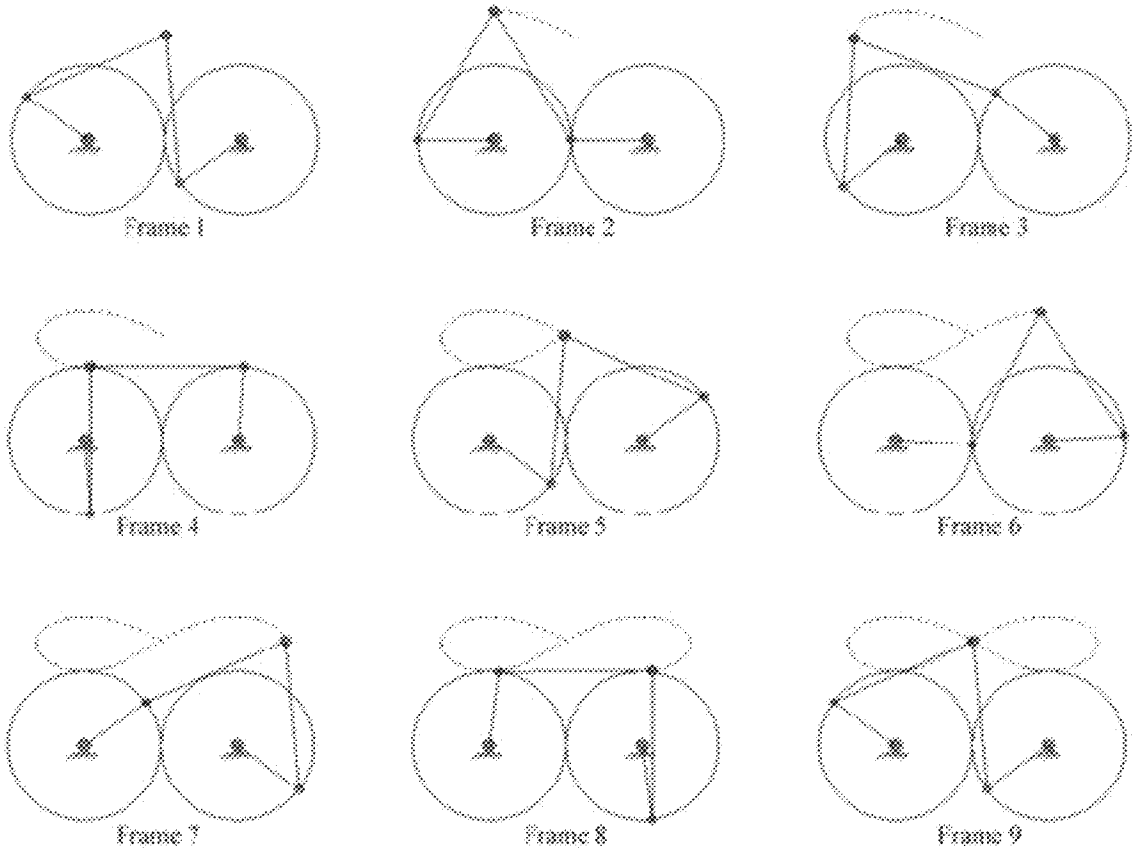
Figure 6Z2

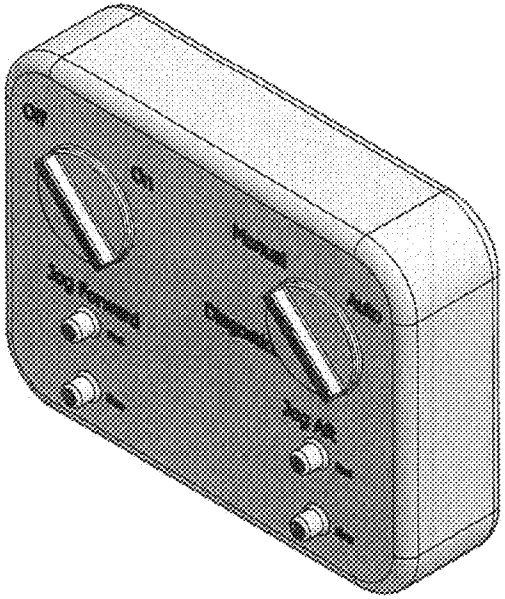
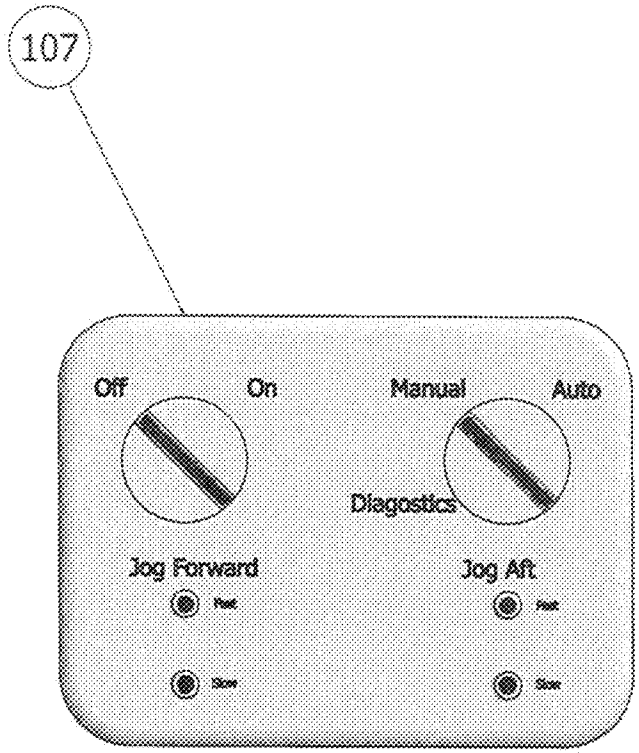
Figure 7A

CHAIN FLAKER SYSTEM, TO DISTRIBUTE ANCHOR CHAIN EVENLY IN ANCHOR CHAIN LOCKER

PRIORITY DATA

The present application claims priority to U.S. Provisional Patent Application No. 62/271,894 filed Dec. 28, 2015, which application is incorporated by reference herein in its entirety.

BACKGROUND

Problem Solved

In recovering or retrieving anchor chain into the anchor locker of a yacht or other watercraft using a customary hydraulically or electrically powered windlass or winch, the chain frequently piles up conically on the locker sole or floor, fouling the windlass because the piled-up chain already in the locker prevents sufficient fall of additional chain coming into the locker from the windlass to pull more in, unless the operator frequently un-piles the chain with a pole—a very difficult, tedious, and distracting task. A mechanical device called a "flaker" can be used to distribute chain in the locker, but existing options are not suitable for mid-sized yachts and other deep water cruising vessels (such as the Fleming Yachts, Inc., F-78 vessel), which employ relatively long and large anchor chains (e.g. 600' of ½" chain) and otherwise experience chain pile-up in the locker fouling the windlass. What is needed is a chain flaker system to distribute anchor chain in such chain lockers in a manner that avoids fouling the windlass and is safe, simple, robust, reliable and easy to manufacture and maintain. The present technology addresses this need in alternative anchor chain distribution patterns as disclosed and described herein.

BRIEF DESCRIPTION OF THE DRAWINGS

FIGS. 6Z1 and 6Z2 are views of a mechanism for an alternative chain distribution methodology.

FIG. 7A are views of a controller for a chain flaker assembly.

DETAILED DESCRIPTION

Figure 1A:
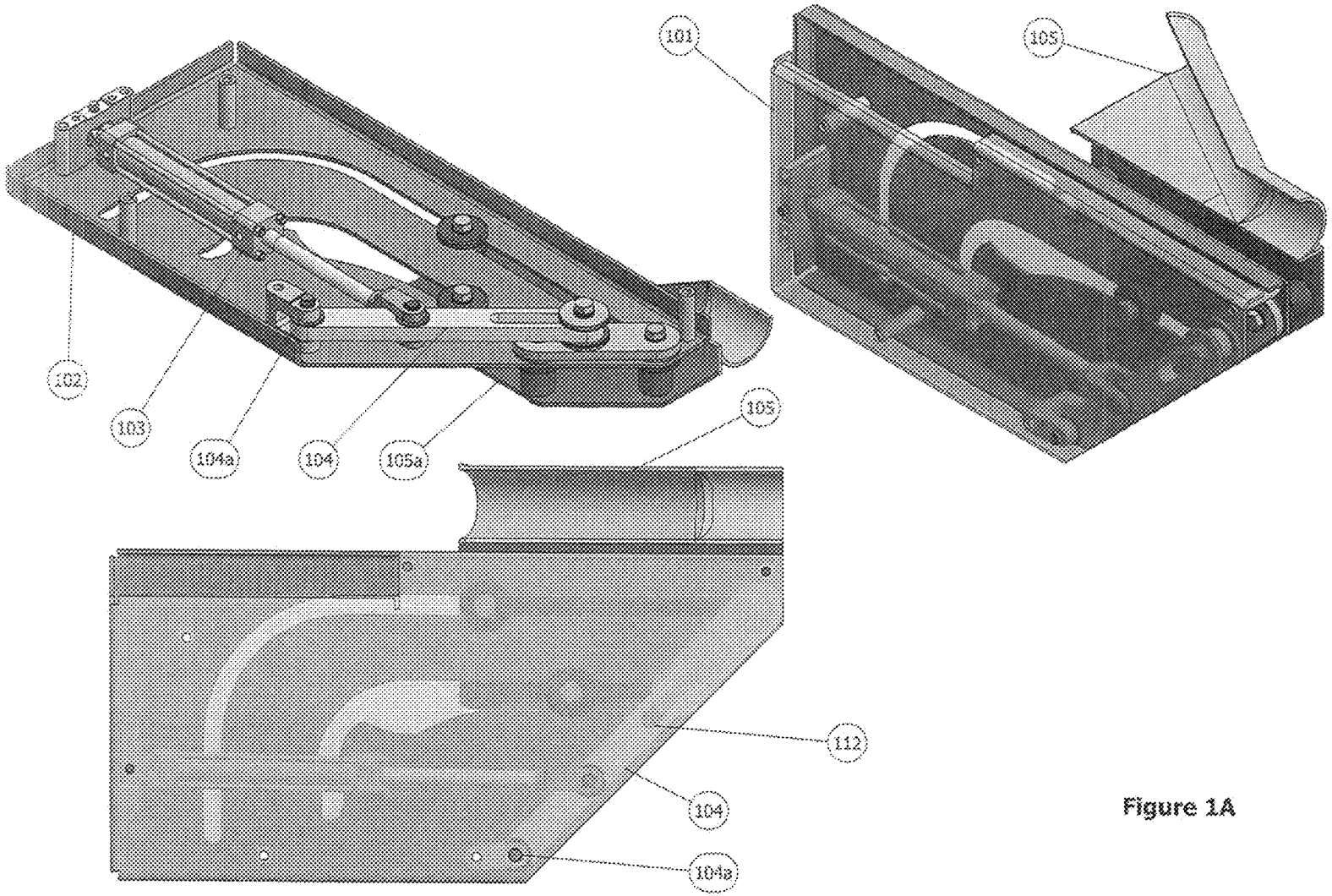
FIGS. 1A-1D are views of the chain flaker assembly in and between its fully extended and retracted positions.
Figure 1B:
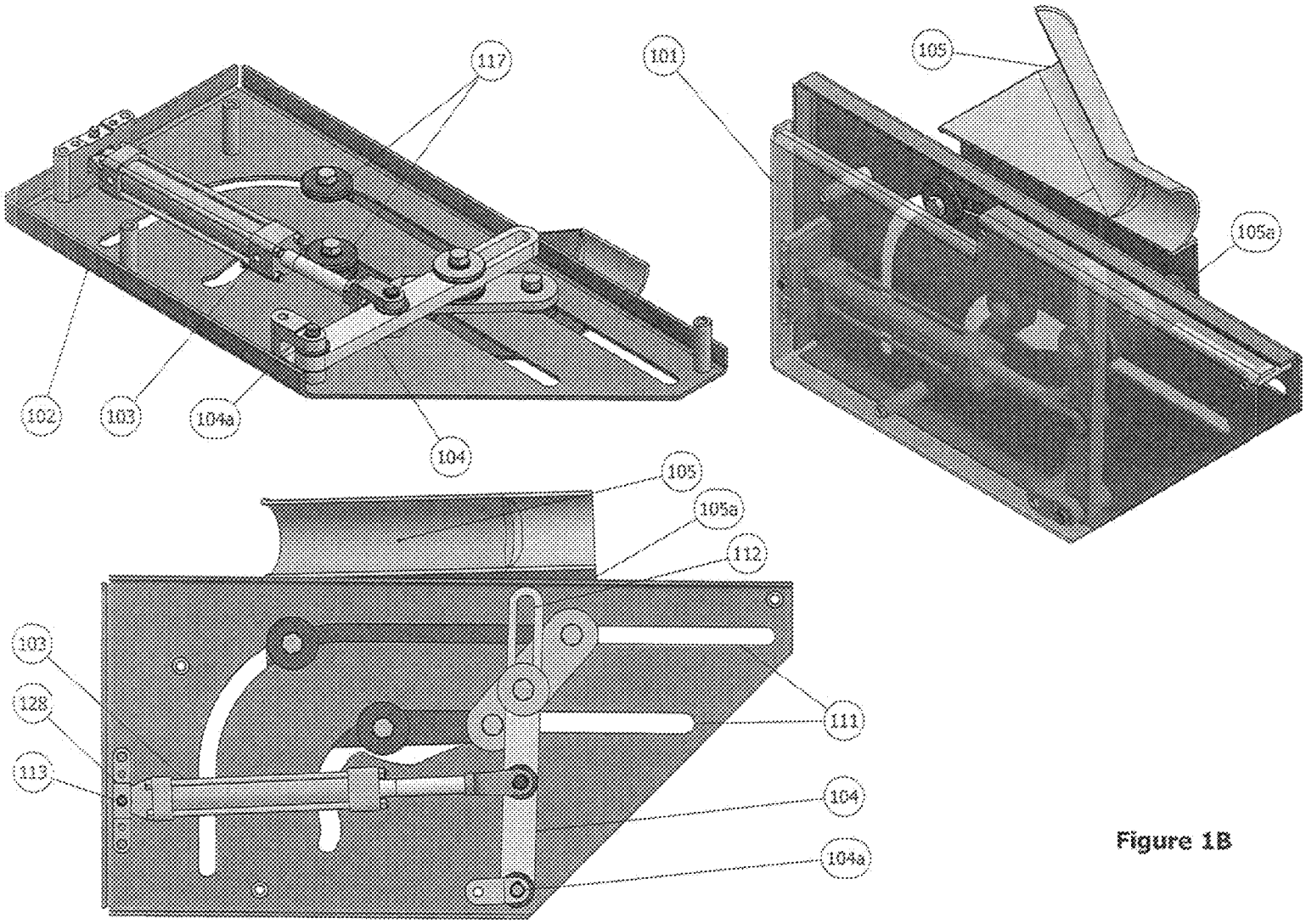
Figure 1C:
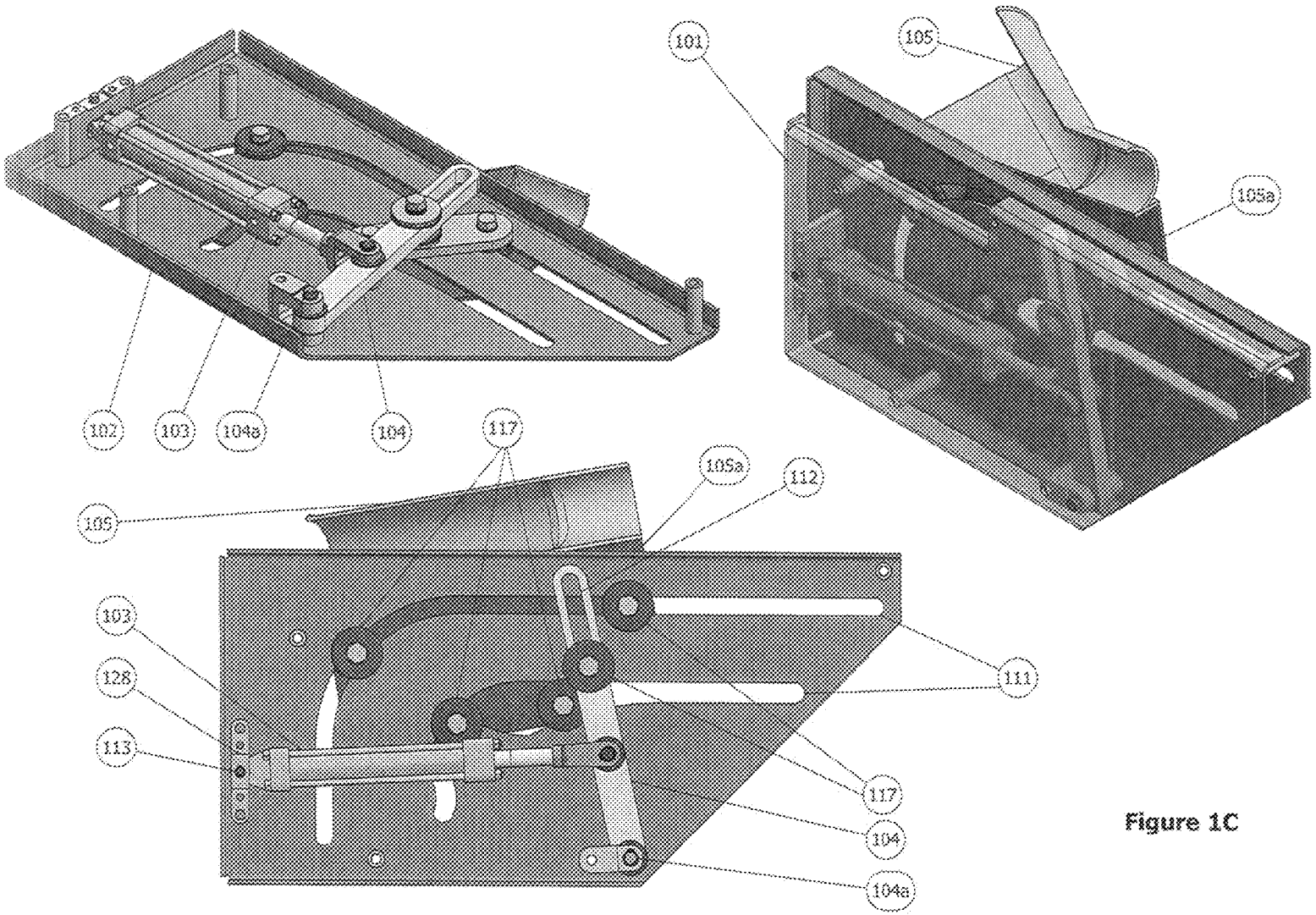
Figure 1D:
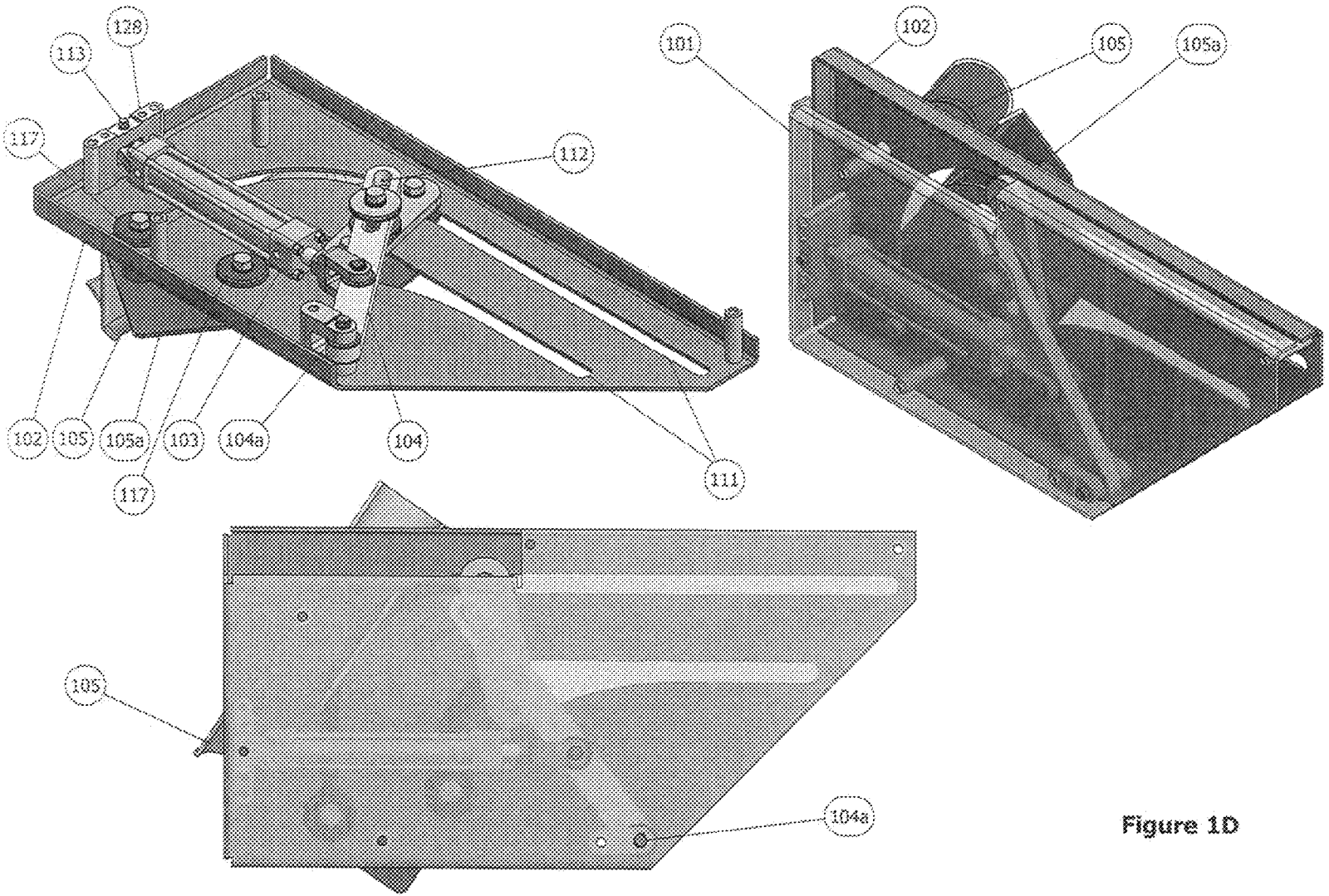
Figure 2A:
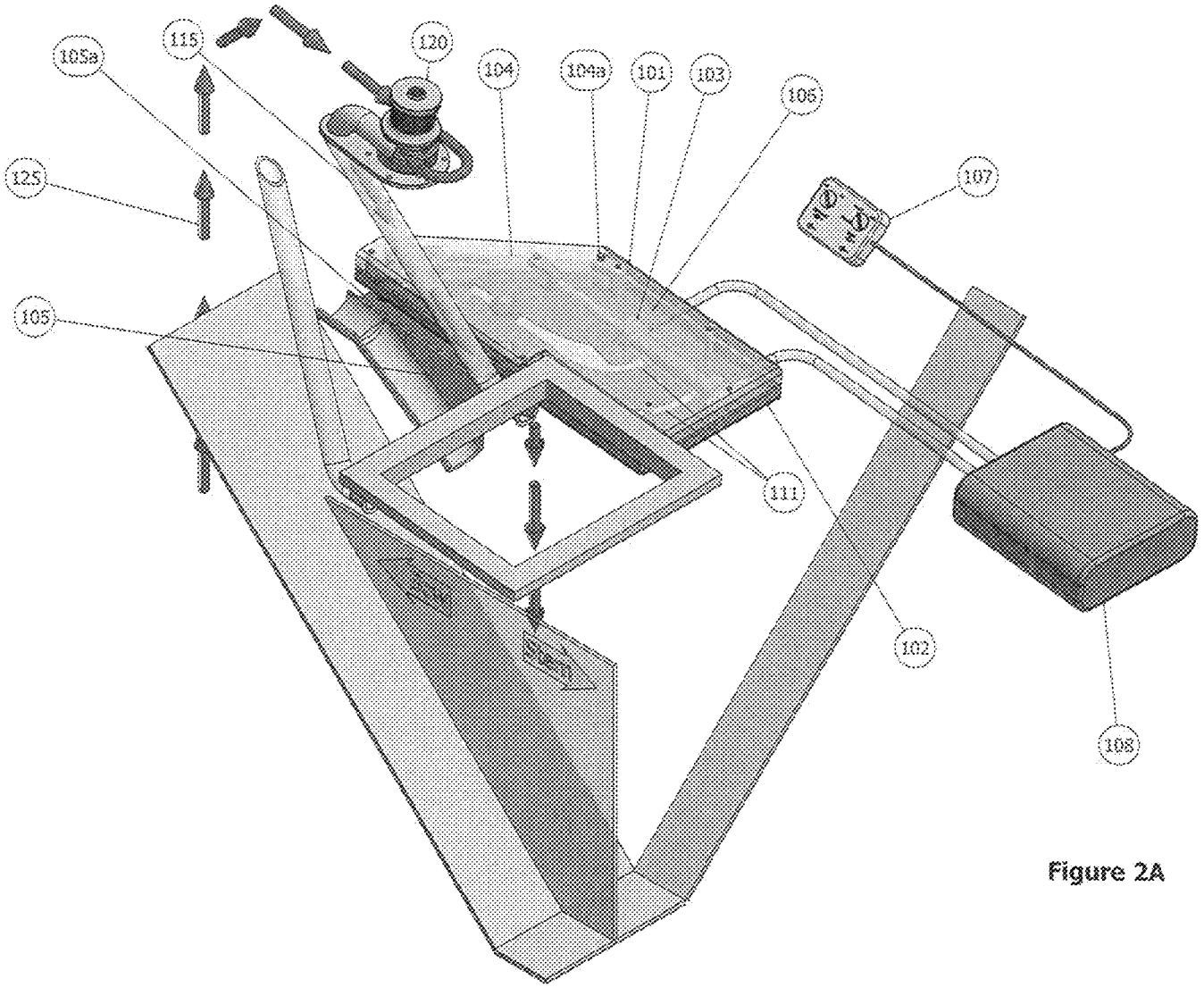
FIGS. 2A-2D are views of the chain flaker assembly in its fully extended position.
Figure 2B:
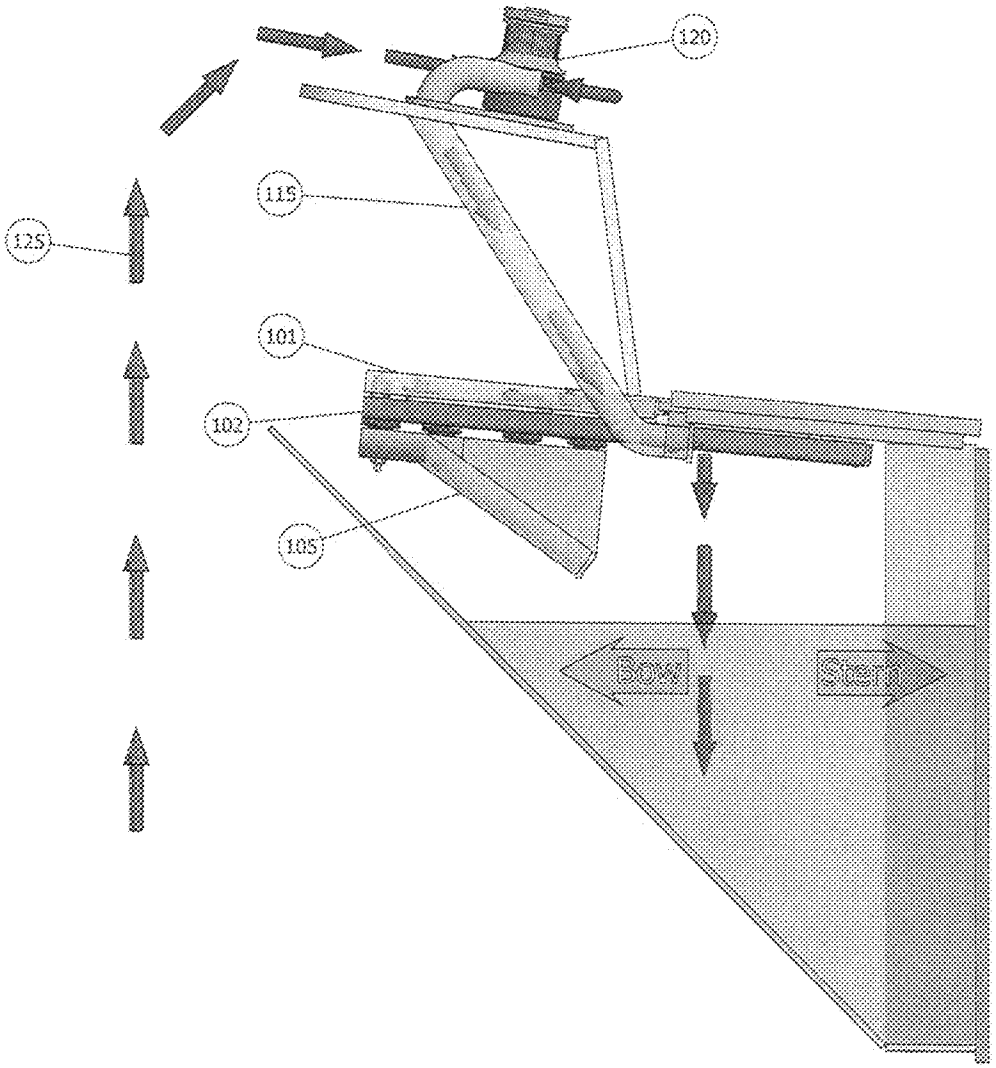
Figure 2C:
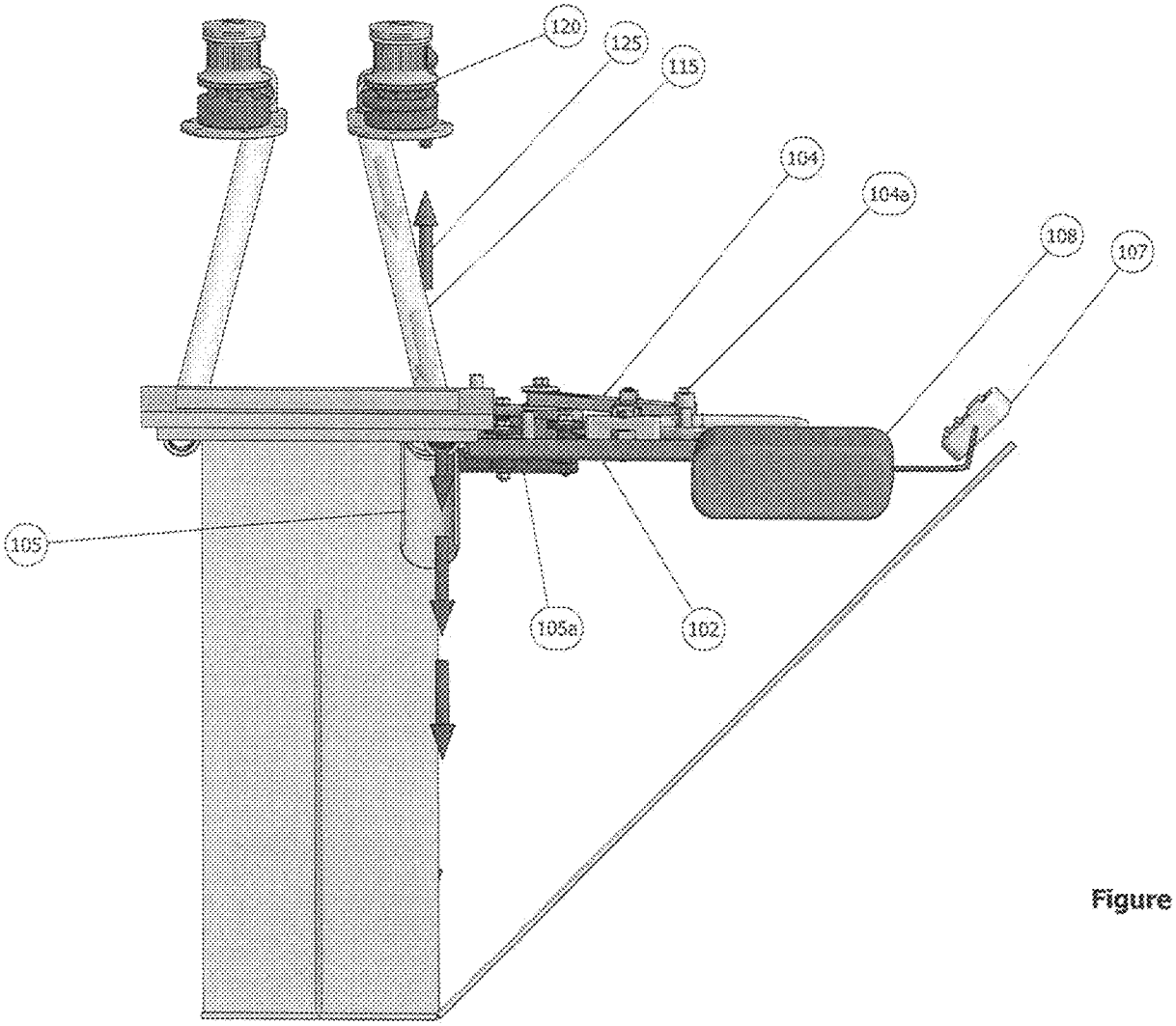
Figure 2D:
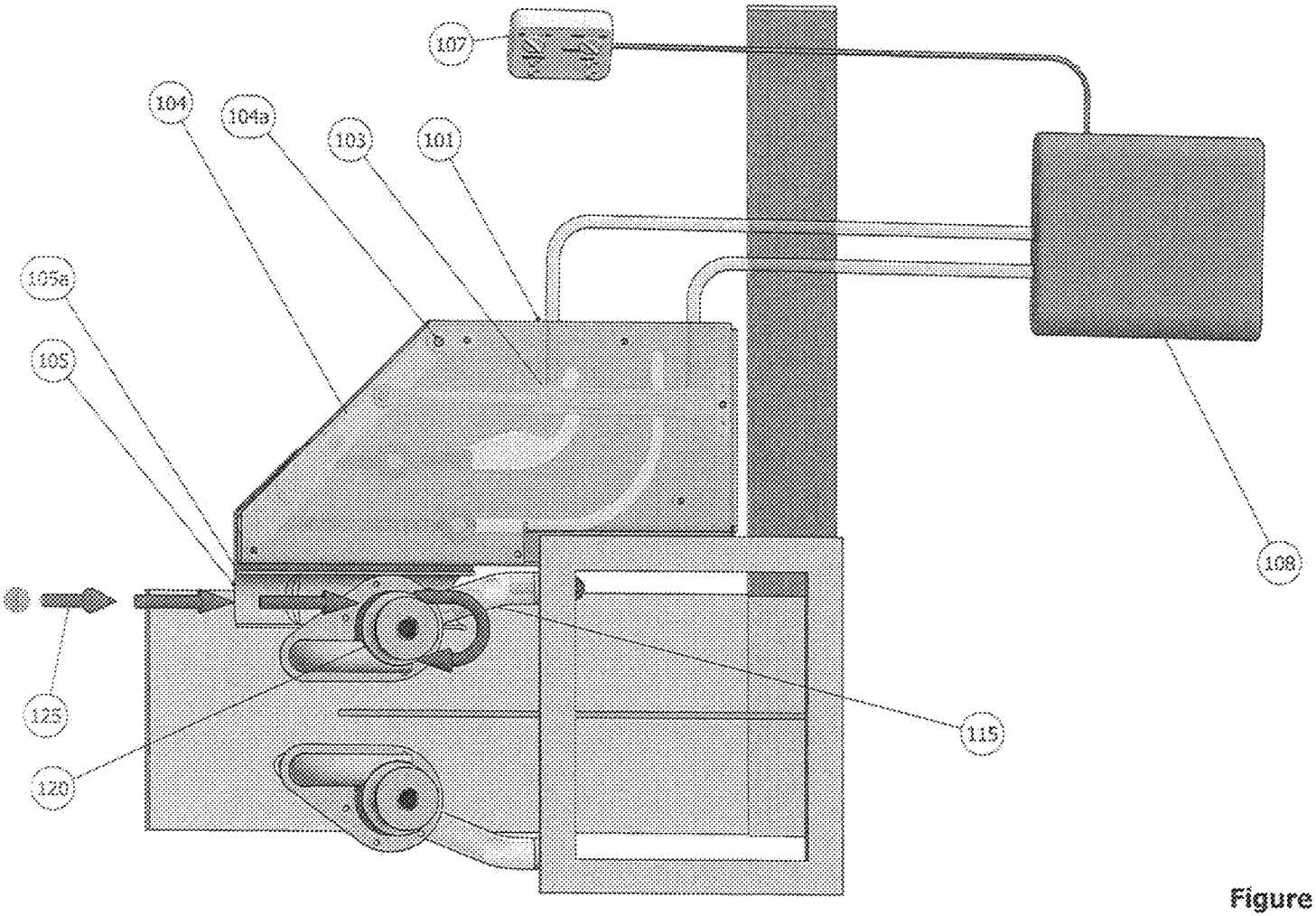
Figure 3A:
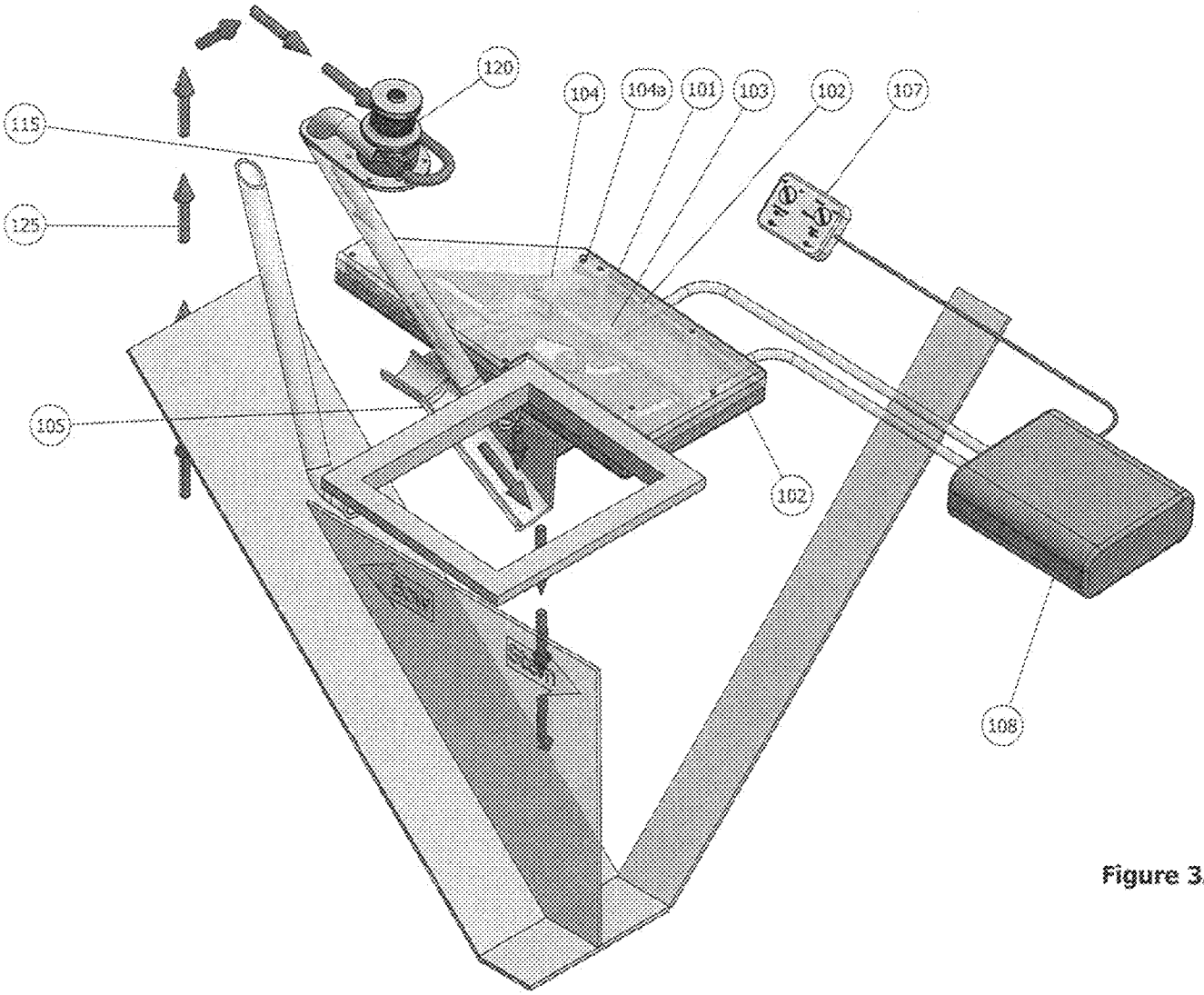
FIGS. 3A-3D are views of the chain flaker assembly in a 30% retracted position.
Figure 3B:
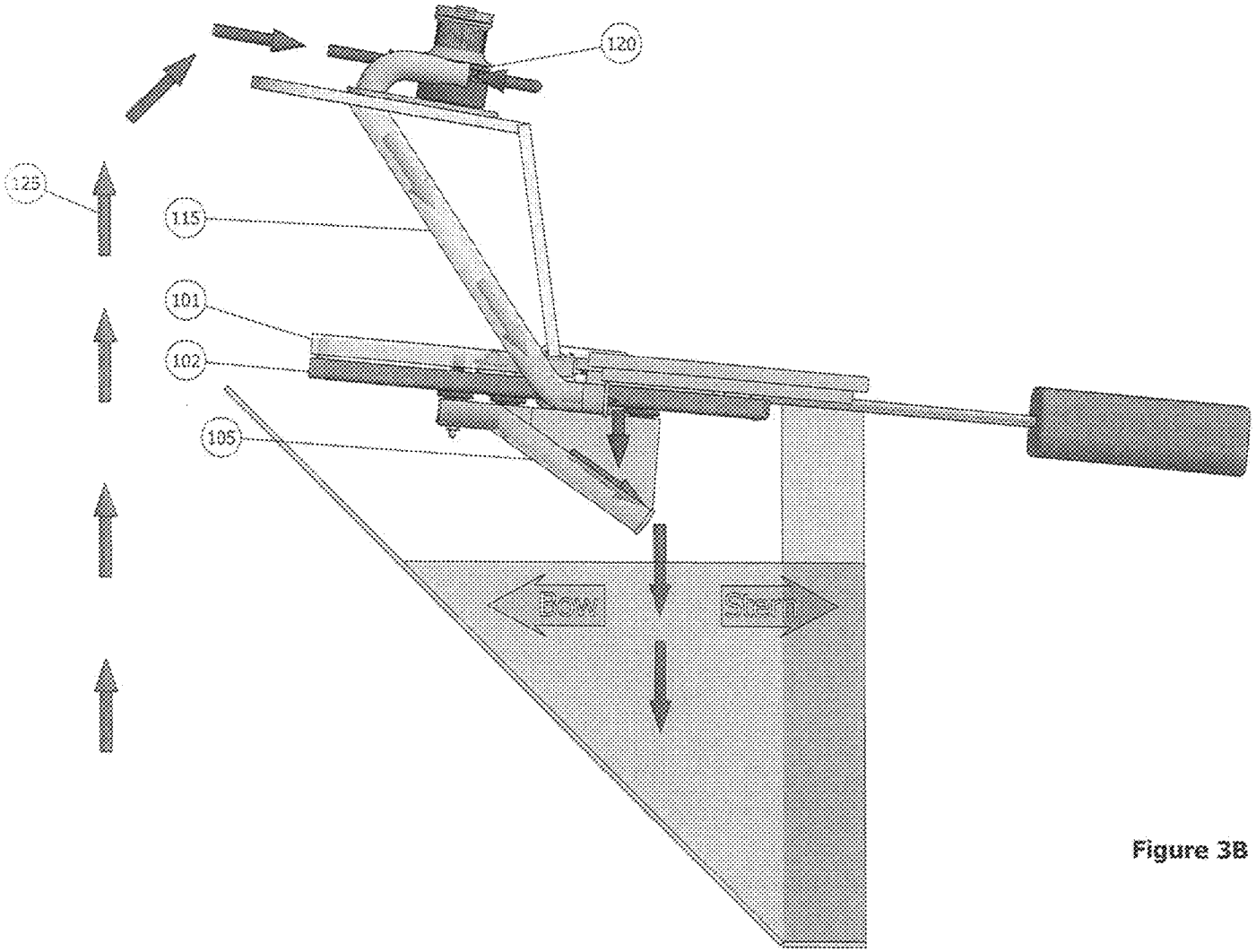
Figure 3C:
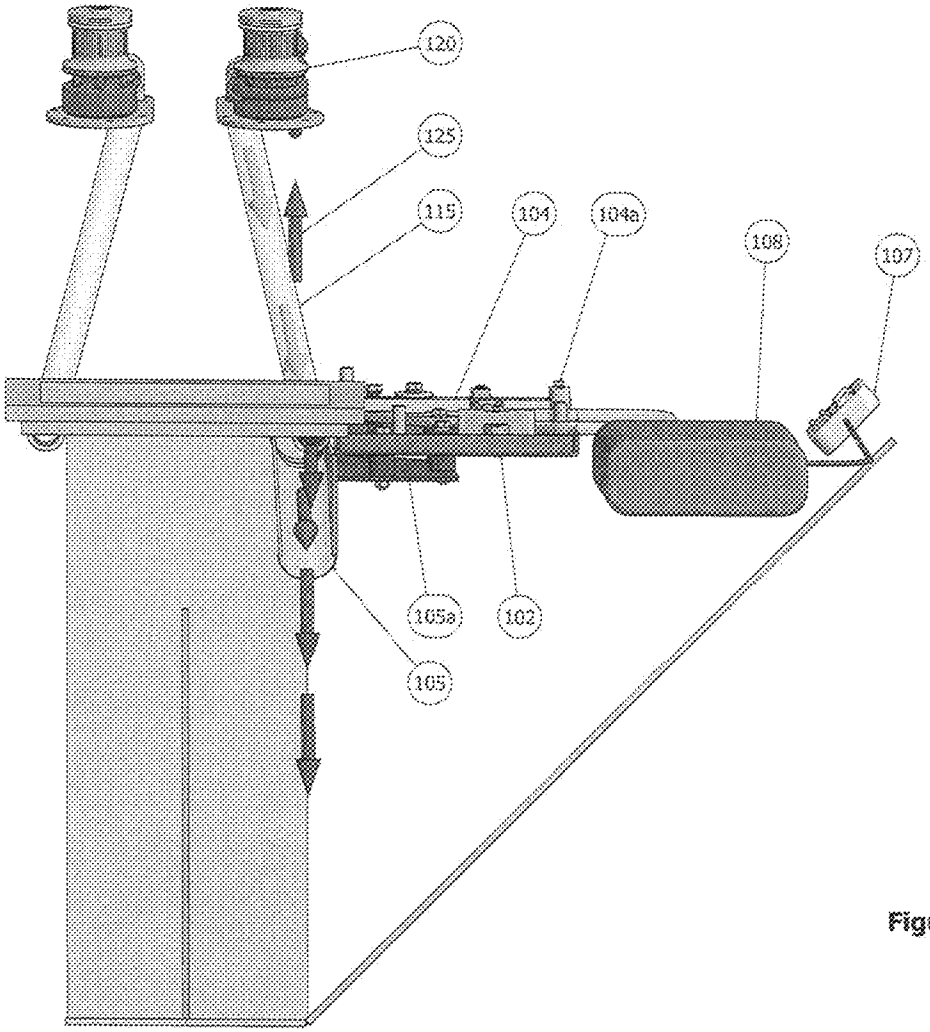
Figure 3D:
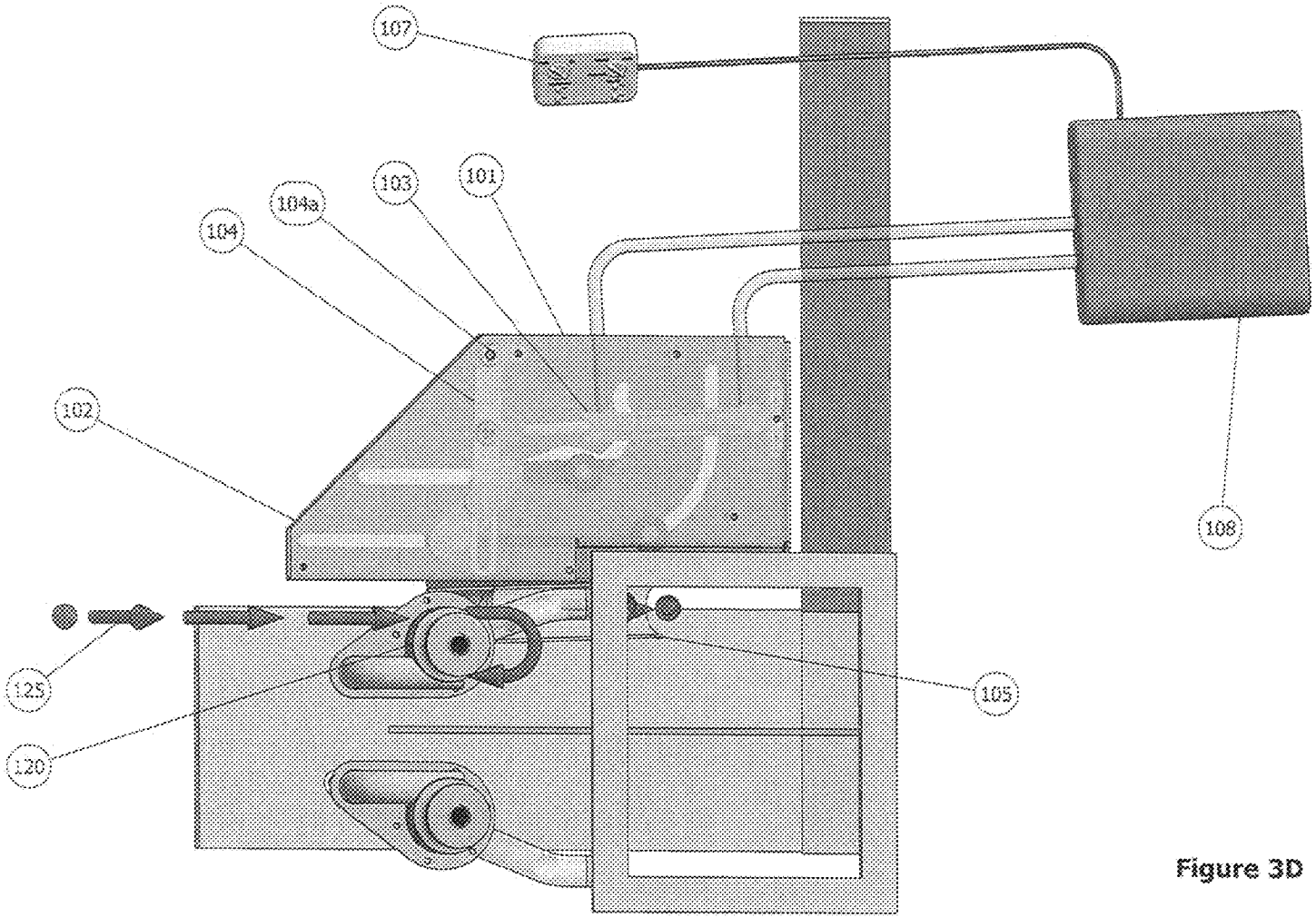
Figure 4A:
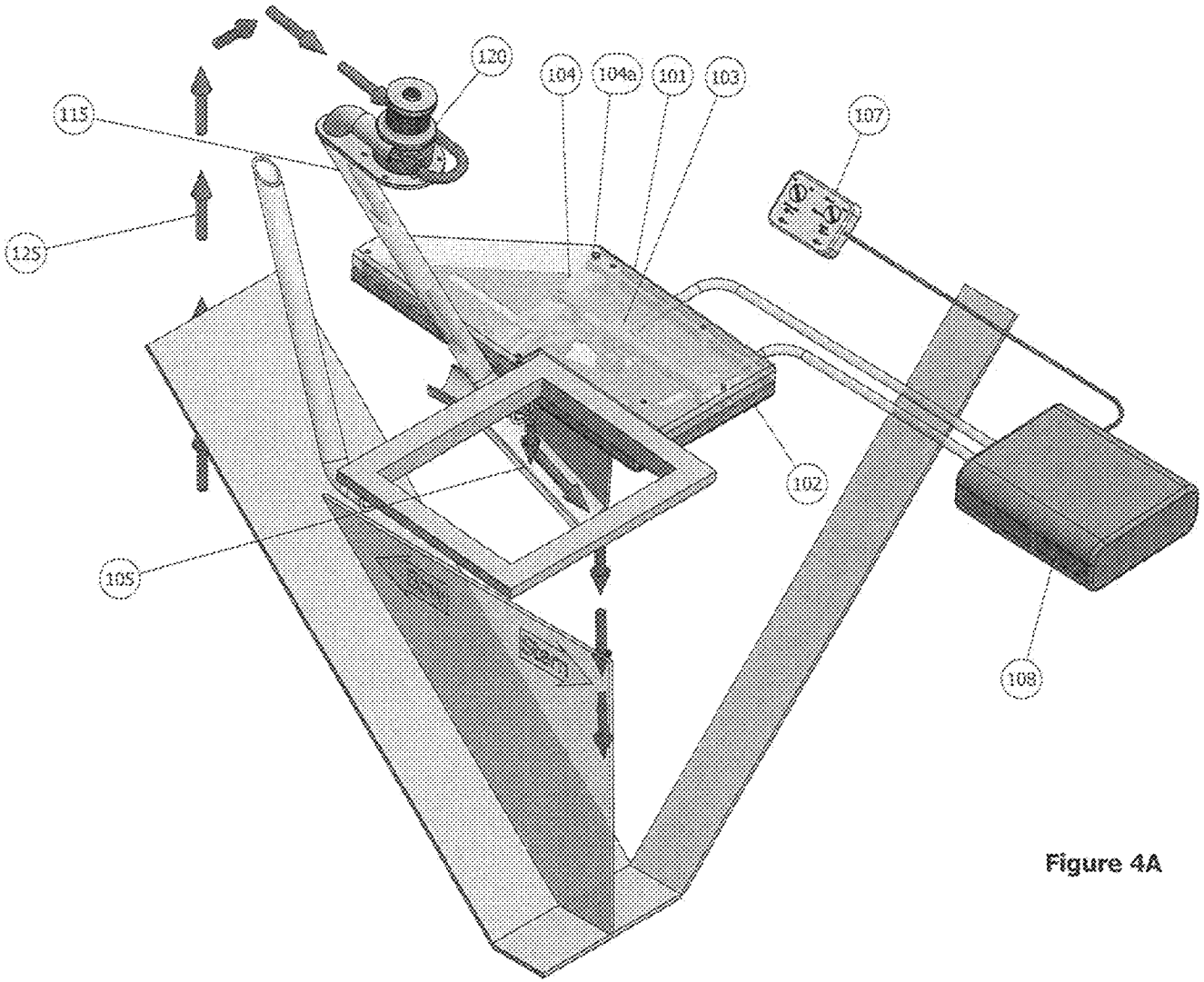
FIGS. 4A-4D are views of the chain flaker assembly in a 70% retracted position.
Figure 4B:
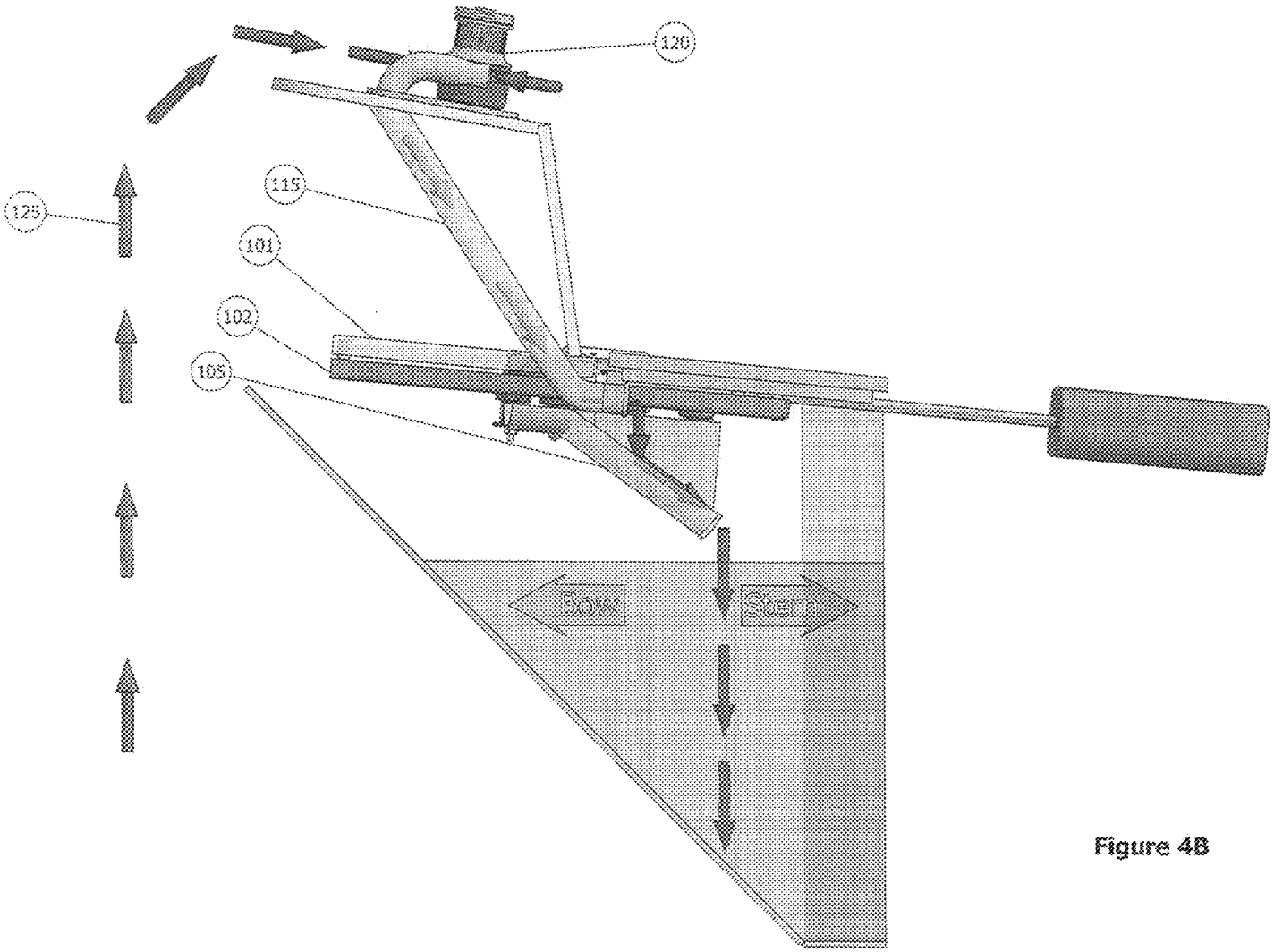
Figure 4C:
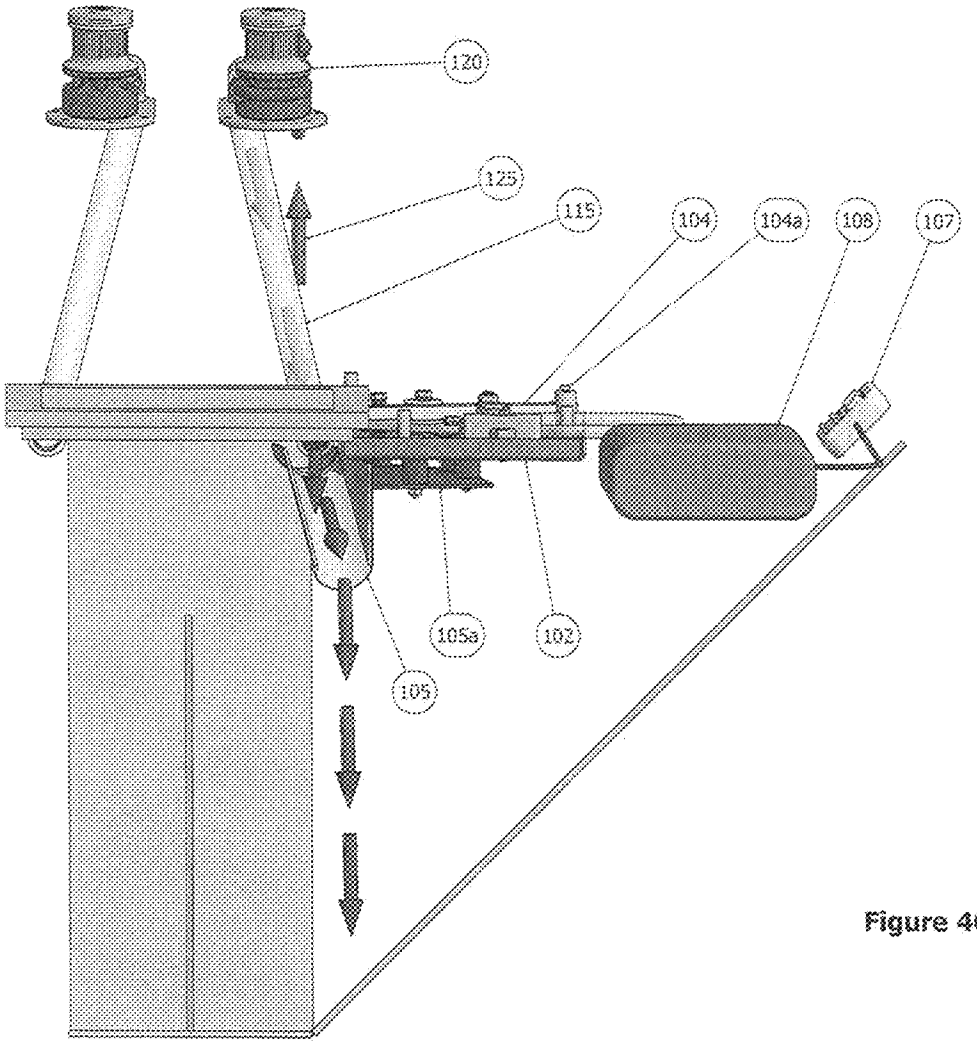
Figure 4D:
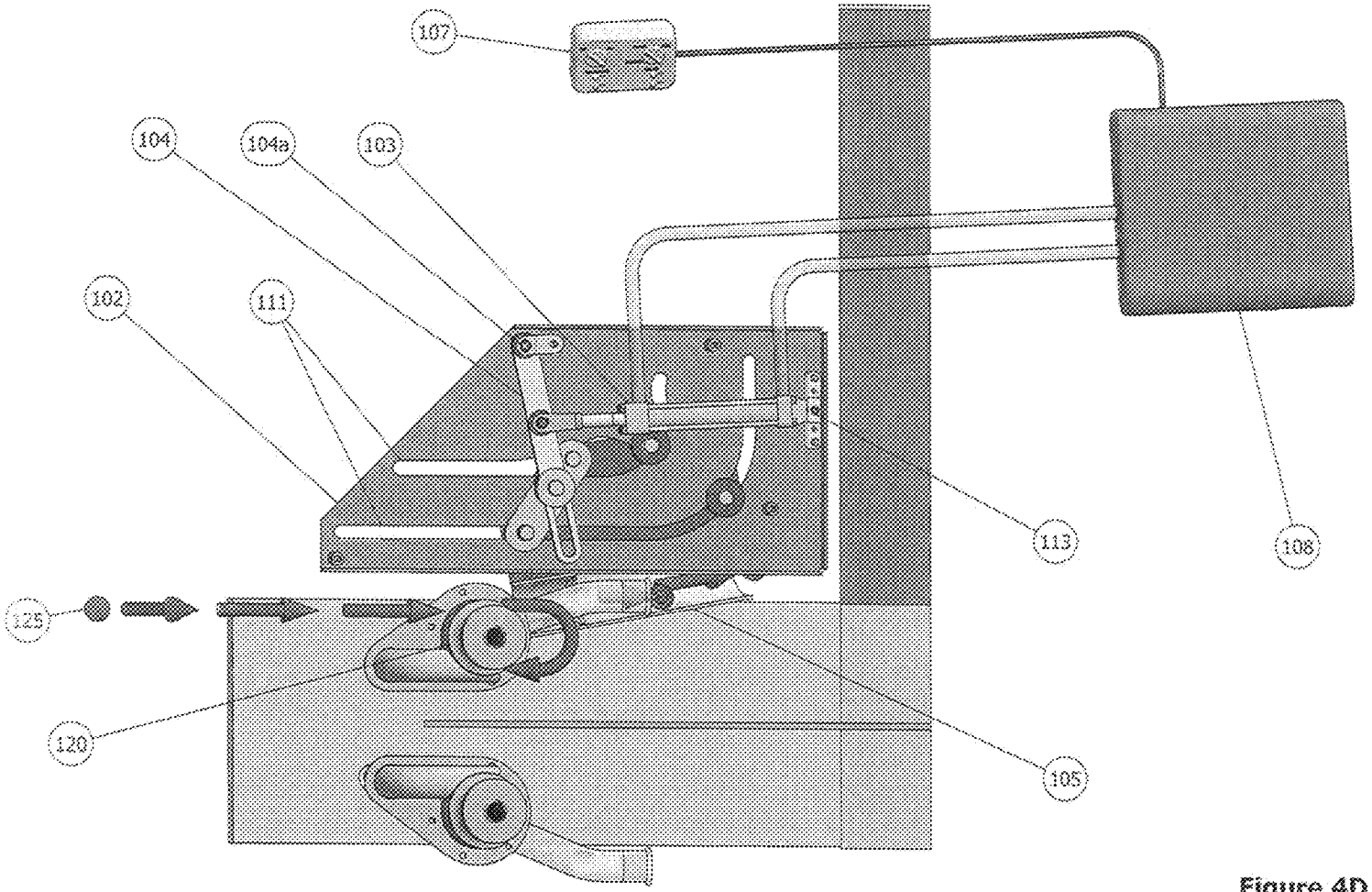
Figure 5A:
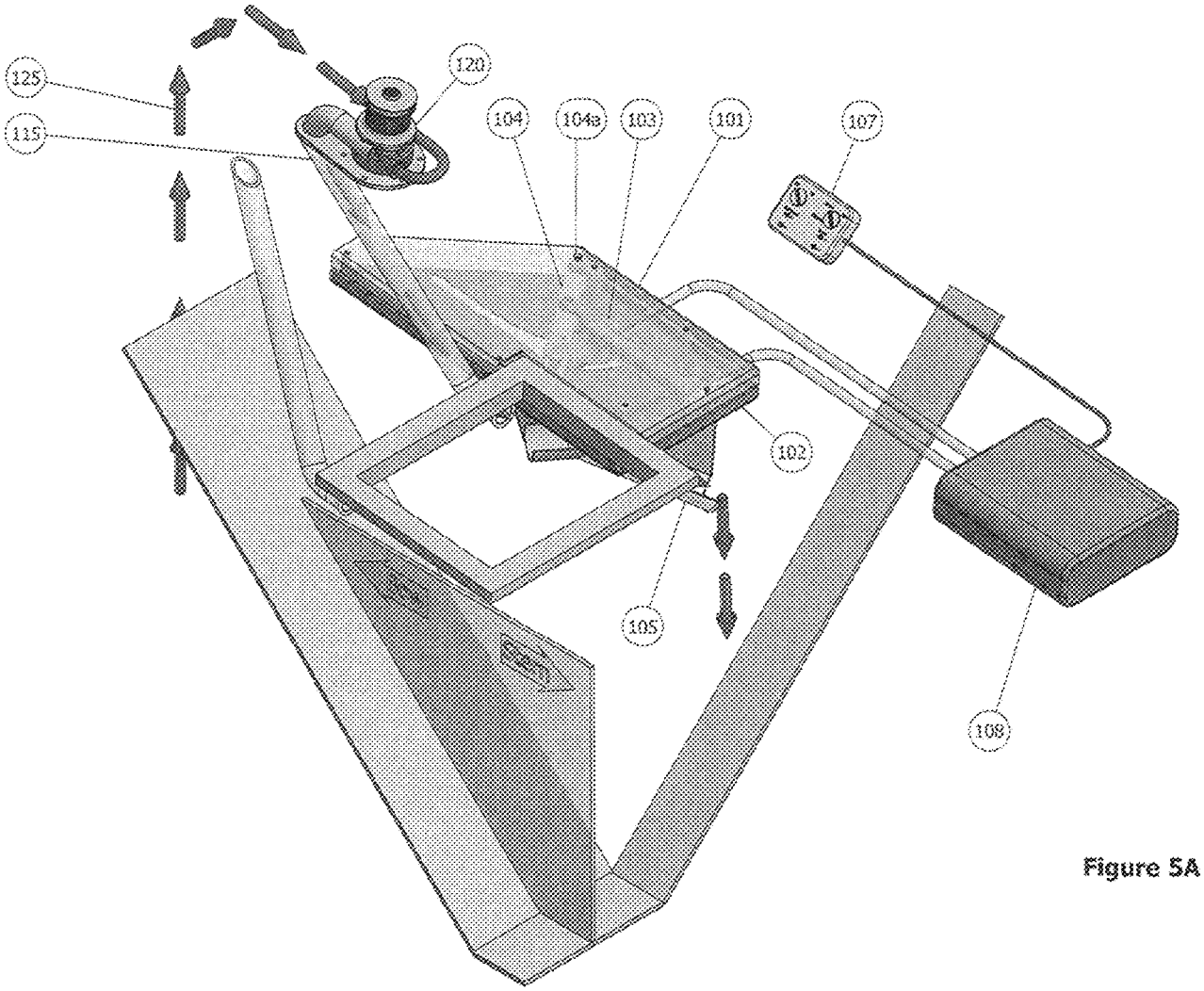
FIG. 5A-5D are views of the chain flaker assembly in a fully retracted position.
Figure 5B:
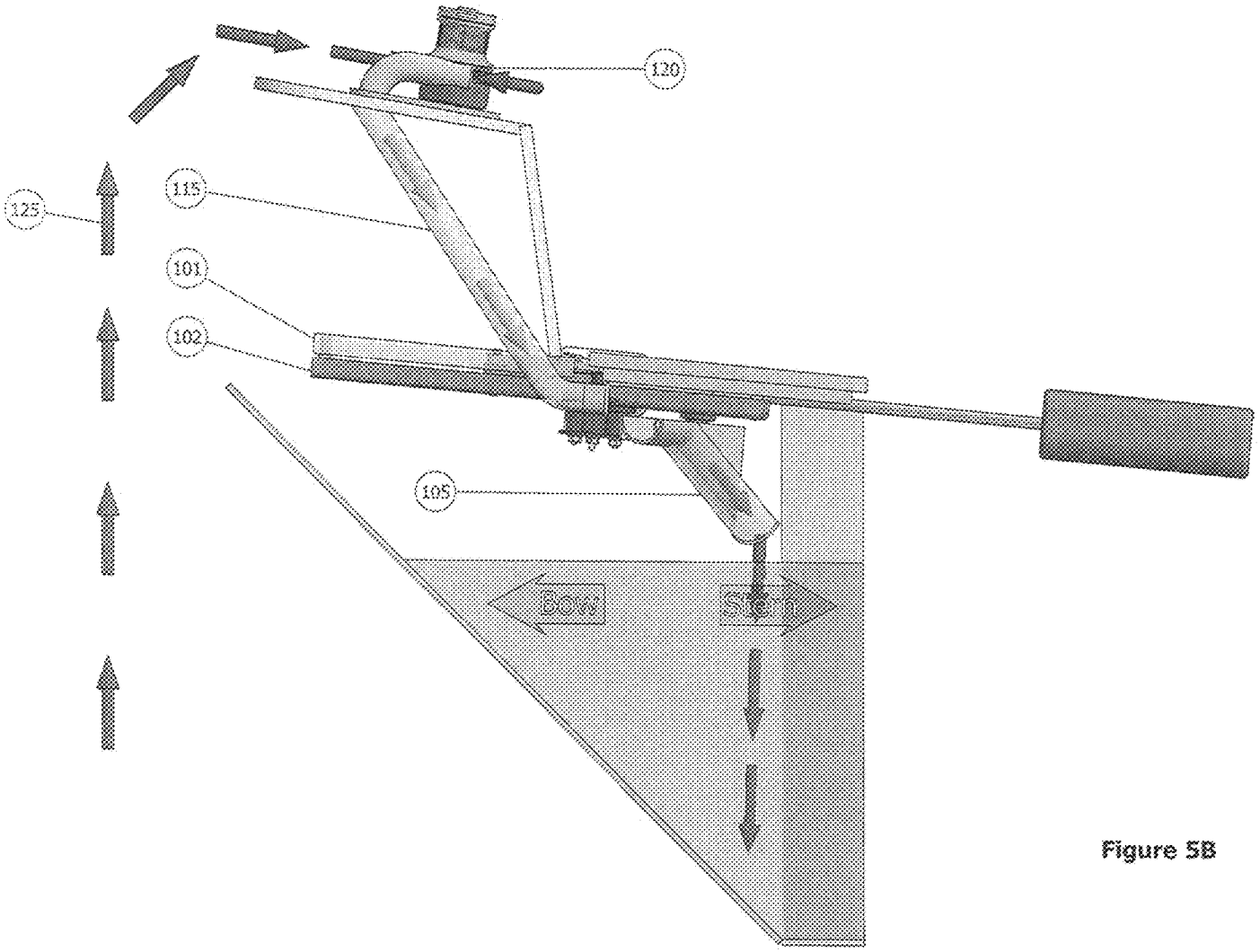
Figure 5C:
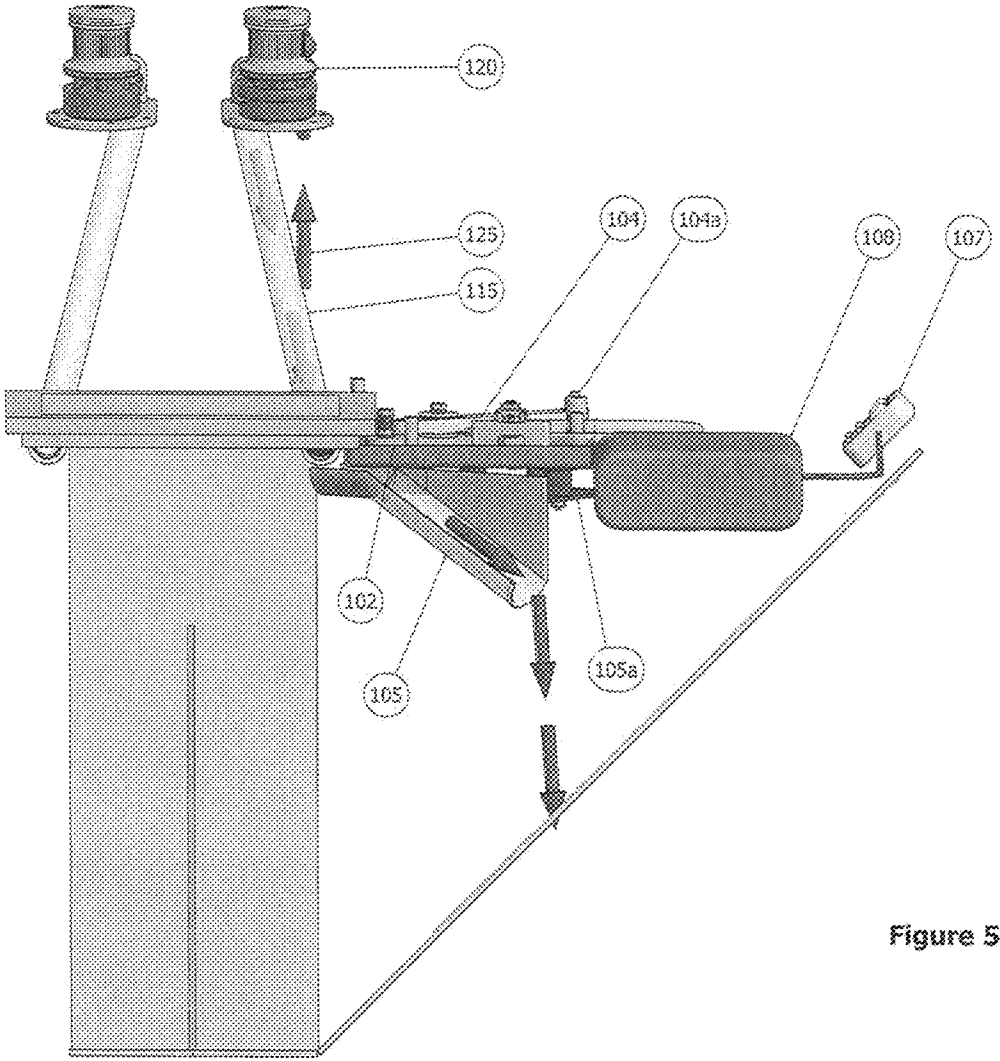
Figure 5D:
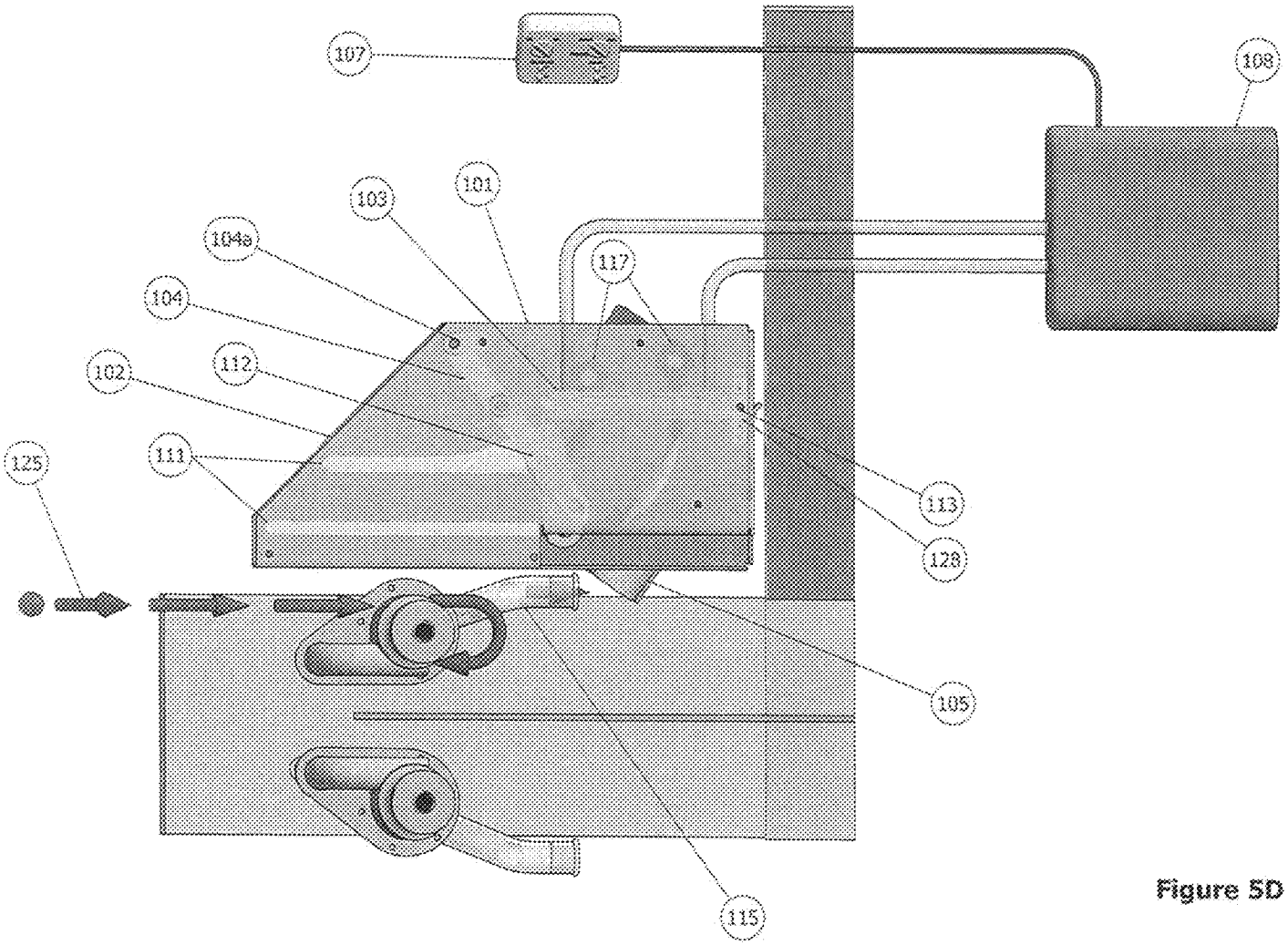

As stated above, anchor chain being loaded into the chain locker during anchor recovery piles up conically, fouling the windlass unless the operator manually un-piles chain in the locker. Our Chain Flaker System—disclosure of which is here provided to seek patent protection—avoids this problem.

The chain flaker system disclosed in this application is operative to relatively evenly distribute anchor chain during its recovery across the chain locker footprint by automatically (and in a controlled manner) moving the drop-point of the chain into the locker through an L-shaped arc, or an alternative figure-8 pattern, during the entire recovery of anchor chain.

One embodiment of the present Chain Flaker System is specifically designed for the initially planned vessel (Fleming F-78). There is no known flaker available globally which will work properly in the Fleming F-78, or similar other vessels and the disclosed invention offers compelling operational benefits. The present technology system is, however, not limited to this particular embodiment or to use with this particular vessel. The disclosed Chain Flaker System: (1) exactly fits a Fleming F-78 chain locker and is reasonably easily modifiable to fit other vessels' similar chain lockers; (2) minimally obstructs access into the chain locker for maintenance; (3) can well handle 600' of ½", or longer smaller, diameter chain in a Fleming F-78 chain locker and be adaptable to more and/or larger diameter chain and/or other vessels similarly configured as to chain locker access but with different sized lockers; (4) is economic, robust, reliable, and easy-to-maintain, including because it is intentionally simple mechanically (e.g. in the L-shaped chain distribution model, a single hydraulic cylinder or linear servo unit powered by hydraulic fluid under desired pressure brought from the nearby windlass' hydraulic system or an auxiliary hydraulic unit; in the figure 8 shaped chain distribution model, a single electric or hydraulic driver rotating a geared wheel which in turn moves other parts); and (5) is easy and safe to operate as essentially automatic in its operation with safety features to minimize risk of injury.

One Embodiment of the Present Technology:

One embodiment of the present technology includes an integrated Chain Flaker System employing an L-shaped chain distribution pattern and comprising the following major components:

1. Top Plate (101): for example, ¼" thick 316 stainless steel.
2. Track Plate (102): for example, ¼" thick 316 stainless steel.
3. Hydraulic Cylinder (103): for example a Miller SH/SHG 316 stainless steel unit, or, in some applications, a Linear Servo Unit.
4. Motion Bar (104): for example, 1" thick titanium or stainless steel.
5. Flaker Fall-tube (105): for example, stainless steel lined with Teflon® or other reduced friction surface, and shaped as half-tube with upward extending sides, with bend-down approximately ¼ way down length of fall-tube.
6. Chain Flaker Assembly (106): comprising 101-105, above.
7. Logic and Controls: for integrated, intended operation of the Chain Flaker System.
8. Remote Control (107) and Power Supply (108): for example, 1× handheld, weatherproof, pendant with 2× rotary switches and 4× momentary, push-button switch, all on a cable which plugs into a receptacle in the starboard (right, when looking forward towards bow) bow locker. The number of switches is by way of example only, and may vary in further embodiments.
9. Port Side Mirror Application: while 101-108, above, are disclosed and described in a configuration intended for the starboard-side chain locker, one of skill in the art will recognize and easily understand how to make a mirror image version intended for the port-side (left when looking forward) chain locker.

Relationship Between Components of the Disclosed Embodiment of the Present Technology: (See Enclosed Drawings 1A Through 5D for Views of One Chain Distribution Methodology and Drawings 6Z1 and 6Z2 for an Alternative Chain Distribution Methodology)

L-shaped Chain Distribution Arc Model: In this method, the anchor chain being recovered is distributed by the Chain Flaker System in an L-shaped pattern in the yacht's anchor chain locker.

The Top Plate (101) bolts to: (1) the underside of chain locker top; and (2) one or more new bracket(s), not shown in the drawings, on the vessel's aft (rear, towards stern) bulkhead (wall).

The Track Plate (102) bolts to the Top Plate (101) and one or more bracket(s), not shown in the drawings, on the aft vessel bulkhead, securing in place the major, stationary parts of the Chain Flaker System, and guiding the moving parts, between the Top Plate (101) and Track Plate (102). Other moving parts may be affixed directly and indirectly to the track plate, including flaker fall tube (105).

The top plate (101) and track plate (102) are stationarily mounted at a top portion of the chain locker. The track plate (102) includes a pair of "L"-shaped slots (111), generally parallel to each other, and extending along the length of the track plate. The Flaker Fall-tube (105) is translationally mounted to the track plate (102) by a mounting plate (105*a*) and a number of bearings (117). In particular, the Flaker-Fall-tube (105) is fixedly mounted to the mounting plate (105*a*). The mounting plate (105*a*) is in turn translationally and pivotally mounted to the track plate (102) by the bearings (117) constrained to ride within the pair of slots (111).

The Flaker Fall-tube (105) and mounting plate (105*a*) are driven along the lengths of the slots (111) by a Hydraulic Cylinder or Linear Servo Unit (103) and a Motion Bar (104). The Hydraulic Cylinder or Linear Servo Unit (103) is mounted at its stern end to the track plate (102) so as to pivot, but not translate, with respect to the track plate (102). The Motion Bar (104) is mounted at its starboard end to the track plate (102) so as to pivot, but not translate, with respect to the track plate (102). The Motion Bar (104) is mounted at its port end to the Mounting Plate (105*a*) by a bearing (117) riding in a slot (112) at the port end of the Motion Bar (104). The Hydraulic Cylinder or Linear Servo Unit (103) is mounted at its forward (rod) end to the Motion Bar (104) along the length of the Motion Bar (104). The Hydraulic Cylinder or Linear Servo Unit (103) is pivotally connected to a plate or bracket (128) at it back end by a pin (113).

The Hydraulic Cylinder or Linear Servo Unit (103) is driven to cyclically extend and contract along its length. Such cyclic extension/contraction of the Hydraulic Cylinder or Linear Servo Unit (103) in turn cyclically pivots the Motion Bar (104) between a first position shown in drawing 1A (referred to herein as a fully extended position), and a second position shown in drawing 1D (referred to herein as a fully retracted position). Movement of the Motion Bar (104) between the fully extended position and the fully retracted position moves the Flaker Fall-tube (105) through its stroke to evenly distribute the anchor chain in the starboard side chain locker as explained below.

Included within this embodiment of the Chain Flaker System is interconnection of the Hydraulic Cylinder or Linear Servo Unit (103) to the hydraulic anchor chain windlass or auxiliary hydraulic power supply to provide: (1) controls, by wire, through an electronic hydraulic controller (preferably an "off-the-shelf" controller) with custom-designed, control logic as described herein and a handheld, weatherproof, remote control on a pendant, with: (a) a rotary switch for disabling the Chain Flaker System as ON/OFF; (b) a rotary switch for mode as AUTO/MANUAL; and (c) a momentary, push-button switches for use in MANUAL mode; and (2) hydraulic fluid, under correct pressure, from the hydraulic anchor chain windlass or auxiliary hydraulic power supply through high-pressure hoses (preferably made from off-the-shelf elements), controlled by the electro-hydraulic system and components described in (1), immediately above.

Operation of the L-Shaped Chain Distribution Model:

Overview:

Drawings 1A-1D show general views of the Chain Flaker Assembly (106).

Several of the drawings depict the anchor chain's travel from the windlass into the chain locker in a representative two of the Flaker Fall-tube's (105) many positions in its L-shaped travel arc fore/aft and athwarthships (perpendicular to fore/aft; in this case, outboard to starboard and then back inboard to port).

In drawing 2B, the arrows 125 illustrate the direction of anchor chain travel as the anchor rises out of the water, turns over the bow roller (not shown) and travels aft to the windlass (anchor chain winch) (120). The windlass (120) pulls the anchor chain out of the water and feeds it into the Spurling Pipe (115). The chain exits the stern-side end of the Spurling Pipe (115) down into the chain locker.

The Chain Flaker Assembly (106) according to the present technology will, at certain positions during its stroke, receive the chain exiting the Spurling Pipe (115) and alter the position at which the chain falls into the chain locker. In particular, when in the forward-most, fully extended, home position as shown in Drawings 2A-2D, the Flaker Fall-tube (105) is spaced away from the Stern-side end of Spurling Pipe (115). Thus, in the fully extended position, the Chain Flaker Assembly (106) does not engage the chain leaving the Spurling Pipe (115), and the chain is laid directly into the chain locker where the Spurling Pipe (115) puts it. Thus, although continuously moving through its stroke, the Flaker Fall-tube (105) is inactive in its fully extended home position, in that it does not engage the chain entering the chain locker.

However, as the Flaker Fall-tube (105) moves through its stroke, at some point during its stroke, the chain exiting the Spurling Pipe (115) falls into Flaker Fall-tube (105). Thereafter, the chain is laid into the chain locker where the Flaker Fall-tube (105) puts it. This position changes as the Flaker Fall-tube moves through its stroke to evenly spread the chain around the footprint of the chain locker as a result of the constant movement of the Flaker Fall-tube (105) in its L-shaped travel arc back and forth.

Drawings 2A through 5D illustrate the operation of the disclosed embodiment in four views (A=Orthographic, B=from port, C=from astern, and D=top-view) through four positions of the Flaker Fall-tube (1=forward-most, 2=30% aft retracted, 3=70% aft retracted, and 4=fully aft retracted).

For example, Drawings 3A-3D show the Flaker Fall-tube (105) during its stroke, 30% aft retracted relative to its fully extended and fully retracted positions. Drawings 3A-3D show the positions of the Hydraulic Cylinder or Linear Servo Unit (103), Motion Bar (104), Flaker Fall-tube mounting plate (105*a*) and Flaker Fall-tube (105) in this position, assuming that the Chain Flaker System is in operation. As shown in Drawing 3B, the chain travels from the existing, fixed hawsepipe (Spurling Pipe) onto/into the Chain Flaker System's Flaker Fall-tube (105) and finally down into the chain locker. It is understood that the Flaker Fall-tube (105)

may engage the chain falling from the Spurling Pipe (115) at a point before or after 30% aft retracted in further embodiments.

Drawings 4A-4D show the Flaker Fall-tube (105) during its stroke, 70% aft retracted relative to its fully extended and fully retracted positions. Drawings 4A-4D show the positions of the Hydraulic Cylinder or Linear Servo Unit (103), Motion Bar (104), Flaker Fall-tube mounting plate (105*a*) and Flaker Fall-tube (105) in this position, assuming that the Chain Flaker System is in operation. The chain travels from the existing, fixed hawsepipe onto/into the Chain Flaker System's Flaker Fall-tube (105) and finally down into the chain locker.

Drawings 5A-5D show the Flaker Fall-tube (105) in its fully retracted position. Drawings 5A-5D show the positions of the Hydraulic Cylinder or Linear Servo Unit (103), Motion Bar (104), Flaker Fall-tube mounting plate (105*a*) and Flaker Fall-tube (105) in this position, assuming that the Chain Flaker System is in operation. The chain travels from the existing, fixed hawsepipe onto/into the Chain Flaker System's Flaker Fall-tube (105) and finally down into the chain locker.

If the Chain Flaker System's controls are set to ON+AUTOMATIC, the following will occur. If the vessel's hydraulic windlass is recovering anchor chain, the Chain Flaker System's Hydraulic Cylinder/Linear Servo Unit (103), using pressurized hydraulic fluid from that windlass system and/or electrical system, will, unless disabled by the ON/OFF switch on the Remote Control (107), slowly but powerfully cycle in/out, which, in turn, will cause the Motion Bar (104), guided by the 2× tracks (111) in the Track Plate (102), to slowly cycle back & forth, pivoting around its starboard end's pivot point (104*a*), which in turn will cause the Flaker Fall-tube (105) to slowly cycle from fully extended (forward-most position) to fully retracted along the two roughly "L"-shaped slots (111) in the Track Plate (102), distributing the anchor chain relatively equally throughout the chain locker during its fall from the Flaker Fall-tube (105). If the hydraulic windlass is NOT recovering anchor chain because anchor recovery is paused, the Chain Flaker's Fall-tube (105) will remain stationary in the position of commencement of the pause. If the hydraulic windlass is NOT recovering anchor chain because the anchor is being dropped, the Chain Flaker System's Flaker Fall-tube (105) will automatically, at a quicker speed than during chain recovery, revert to its home position (forward-most; out of the way of chain exiting from the forward part of the chain locker from the existing, fixed, hawsepipe (Spurling Pipe) or fall-tube) and remain there.

If the Chain Flaker System controls are set to ON+MANUAL, then the automatic interconnect between the system controls from the windlass will be disabled in favor of operation only by the Remote Control's (107) momentary ON/OFF push-button switches, which will momentarily actuate movement of the Flaker Fall-tube (105) only if vessel's hydraulic system is under pressure (i.e. main engines and their associated hydraulic pumps running or auxiliary electric-driven hydraulic pump running and valved into the hydraulic system or in the case of a linear servo unit electrical power is supplied to it). This mode is generally intended to be used only for calibration or other maintenance, but can if the need arises enable the full operation of the chain flaker under supervised manual control.

If the Chain Flaker System control is set to OFF, the entire system will be disabled from any operation, which, as an important safety feature, will be the normal resting condition for the Chain Flaker System.

If the Chain Flaker System control is set to Diagnostic mode then the Chain Flaker will operate as if it is in Automatic mode whether or not the windlass is recovering anchor chain and continue to do so until either taken out of Diagnostic mode or turned off.

The embodiment described here is a starboard side Chain Flaker System. A mirror image of the starboard side Chain Flaker System's Chain Flaker Assembly (106), with associated logic and controls, can be readily made based on the same mechanical and operational approach to successfully flake a port anchor's chain into that side's mirrored chain locker. The system can also be applied to a vessel which only has a single bow anchor system typically located more central athwartships in position.

The offset of our Chain Flaker Assembly (106) from the chain locker hatch is optional but highly desirable for access to that locker (e.g. for maintenance). Also, some features of the control system and logic earlier described are not essential for manual operation, and are therefore optional in that mode. But, as the major objective is to remove piling-up of anchor chain in the locker, automatic operation (without requiring constant attention to how chain is situated in the locker), will be the much preferred mode in normal operation.

How to Use the L-shaped Chain Distribution Model:

To use our Chain Flaker System's L-shaped chain distribution model, a person will normally just set the Remote Control's (107) applicable rotary switches to ON (instead of OFF) and AUTOMATIC (instead of MANUAL) and the Chain Flaker System will operate automatically, electronically and hydraulically coupled to operation of the nearby windlass. If needed for calibration or other maintenance, the Flaker Fall-tube (105) could be momentarily moved by having the applicable rotary switches set to MANUAL and momentarily depressing the desired ON push-buttons.

Figure-8 Chain Distribution Model:

One skilled in the art could develop a similar chain flaker system employing other than an L-shaped chain distribution method. For example, a figure-8 shaped distribution method as depicted in Drawings 6Z1 (3d model) and 6Z2 (top view depiction of 9× frames of movement). Such distribution method could be achieved by slowly rotating clock-wise two same-sized, circular, flat, geared wheels with: (1) power being delivered to the wheels by a center shaft of one or both wheels being driven by high-torque, low-speed, hydraulic or electric driver(s) rotating clockwise; (2) two mechanical arms attached at one end to the perimeter of the two wheels and hinged together at the other end. The chain flaker tube could be attached where the two mechanical arms are hinged together so that the chain flaker tube would be slowly propelled in a figure 8 in order to drop chain into the chain locker in that pattern.

Configuration and location of the figure-8 chain distribution model would be different than the L-shaped arc model, but control and power logic and components would be very similar to the L-shaped arc model.

Advantages of the present design over conventional flaker designs include that the motion bar moving within the track plate are able to move the flaker fall tube to distribute the anchor chain evenly within an anchor well, distributing the chain in varying fore/aft and port/starboard positions. Additionally, the shape of the track plate, and slots within track plate, may be customized so that the movement of the motion bar and flaker fall tube may be customized to evenly distribute the anchor chain over a large range of anchor well sizes and shapes. Additionally, by providing moving linkages which distribute the chain in controllable varying fore/aft and port/starboard positions, the chain can be directed to specific target areas to maximize the flaker's effectiveness.

Additionally, the simple and robust design can be used with any size chain appropriate to the vessels size of which the chain flaker is fitted to. Moreover, as the chain flaker assembly is positioned beneath the hawsepipe, the assembly stays out of the way of the hawsepipe and anchor well hatches. Also, should maintenance or repair be required, the chain flaker assembly can be removed without having to disconnecting the bitter end of the chain, and without having to thread all of the chain out and then reverse to reinstall. The importance of this is magnified should there be any failure at sea when the anchor is in use.

As a further advantage, the chain flaker assembly engages the chain from the hawsepipe for only a portion of its stroke. This provides the ability to completely disengage itself for part of its stroke from the chain increases the anchor well area to use. Additionally, by completely disengaging out of the way of the chain allows for zero restriction during anchor deployment.

The above-described embodiments are effective at evenly distributing the chain within the port and/or starboard side chain locker(s). However, as the chain begins to fill the locker, the gravitational force of the chain leaving the chain flaker fall-tube (105) decreases while the frictional forces between the chain and the chain flaker fall-tube (105) remain constant. In order to ensure proper movement of the chain through the chain flaker assembly, embodiments of the present technology may additionally include a power assist assembly toward an end of the chain flaker fall-tube (105). Such a power assist assembly is now described with reference to FIGS. 8A-8F.

FIGS. 8A-8F show a power assist assembly including a chain roller (155) powered by a hydraulic chain roller motor (150). The motor (150) drives the chain roller (155) during chain retrieval, which advantageously pulls the chain to counteract frictional forces which build between the chain and at least portions of the Spurling pipe (115) and the chain flaker fall-tube (105). When the anchor is being deployed and the chain travels in the opposite direction, the motor may be off or disengaged so that the chain roller (155) is free spinning. Additionally, it is conceivable that the motor 150 be omitted, and the chain roller (155) be free-spinning at all times, to alleviate friction at least between the chain and portions of the chain flaker fall-tube (105).

Figure 8A:
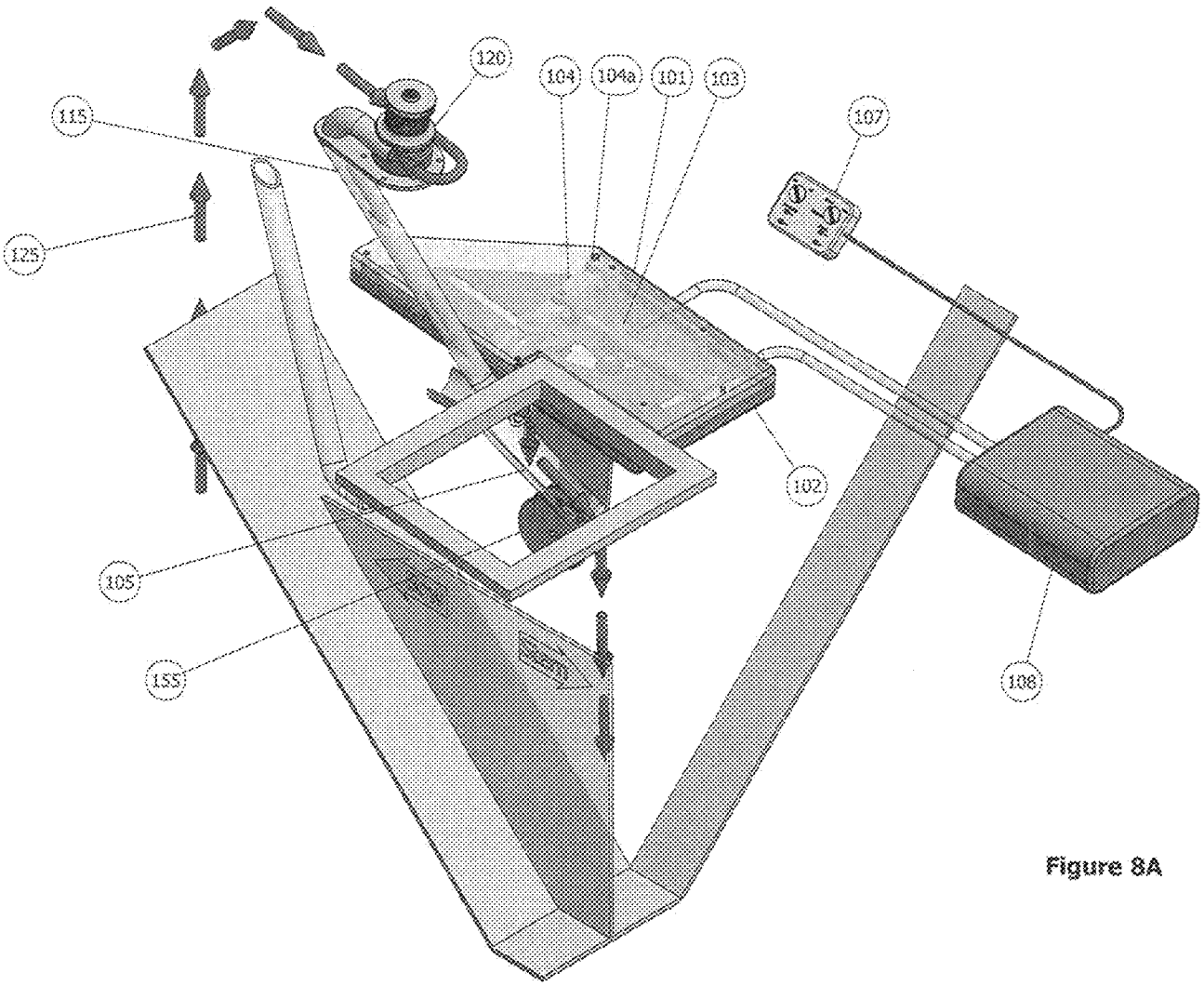
FIGS. 8A-8F are views of a chain flaker assembly including a power assist assembly.
Figure 8B:
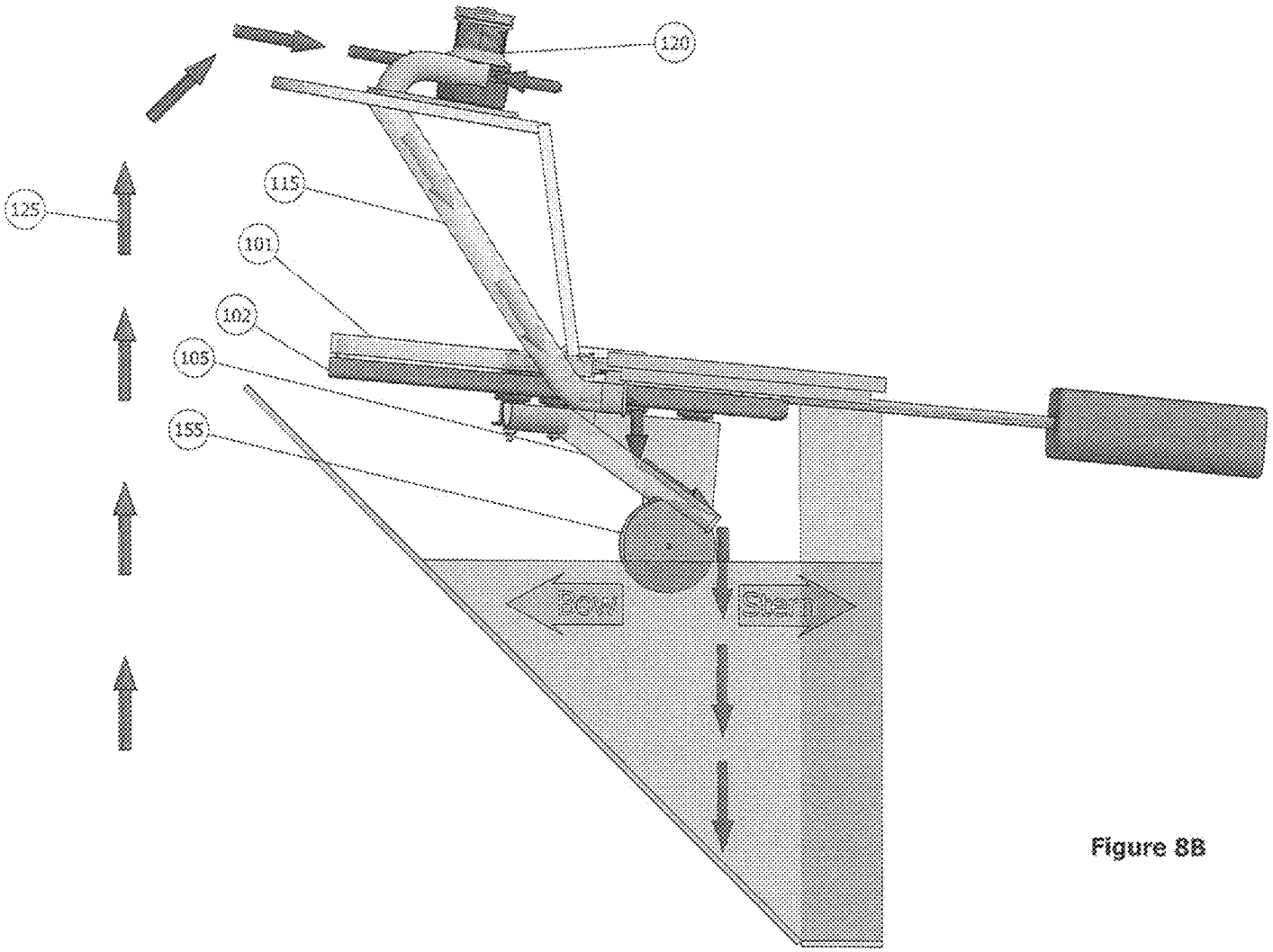
Figure 8C:
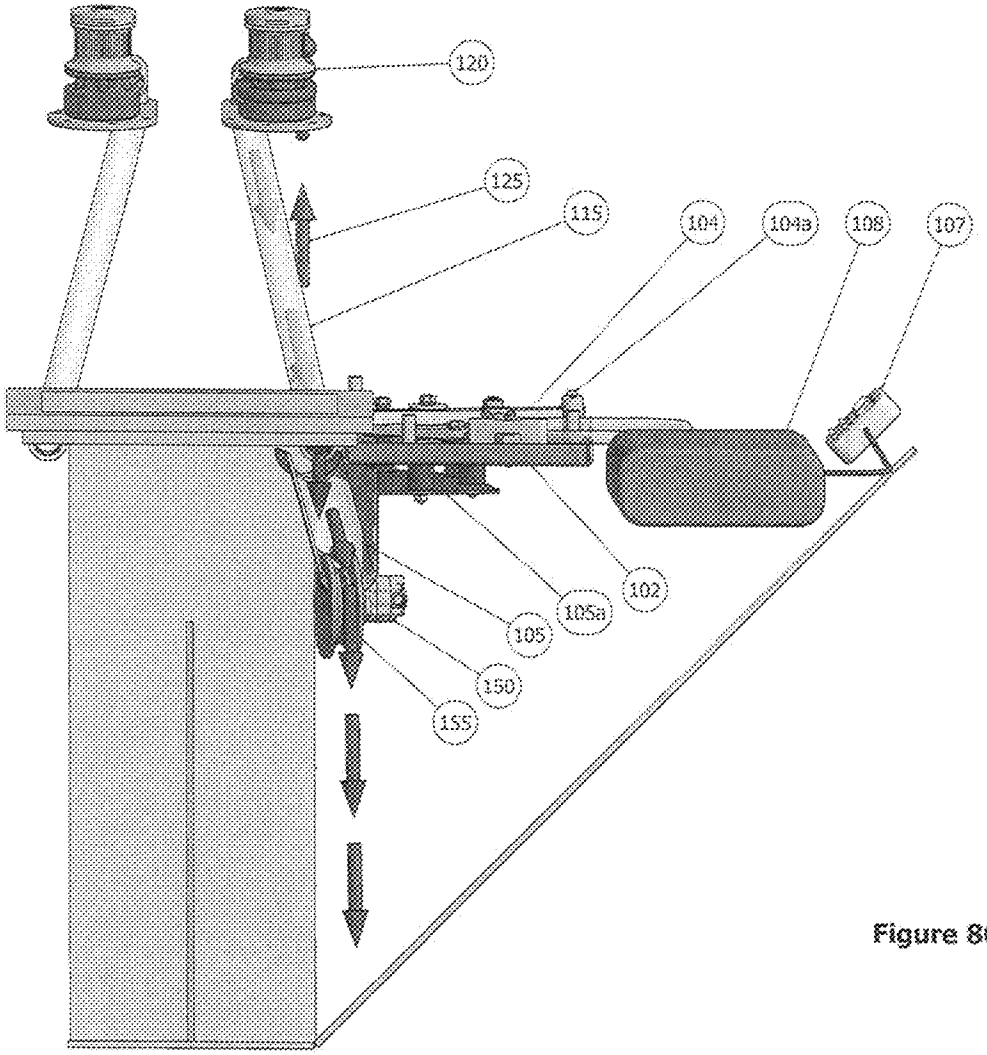
Figure 8D:
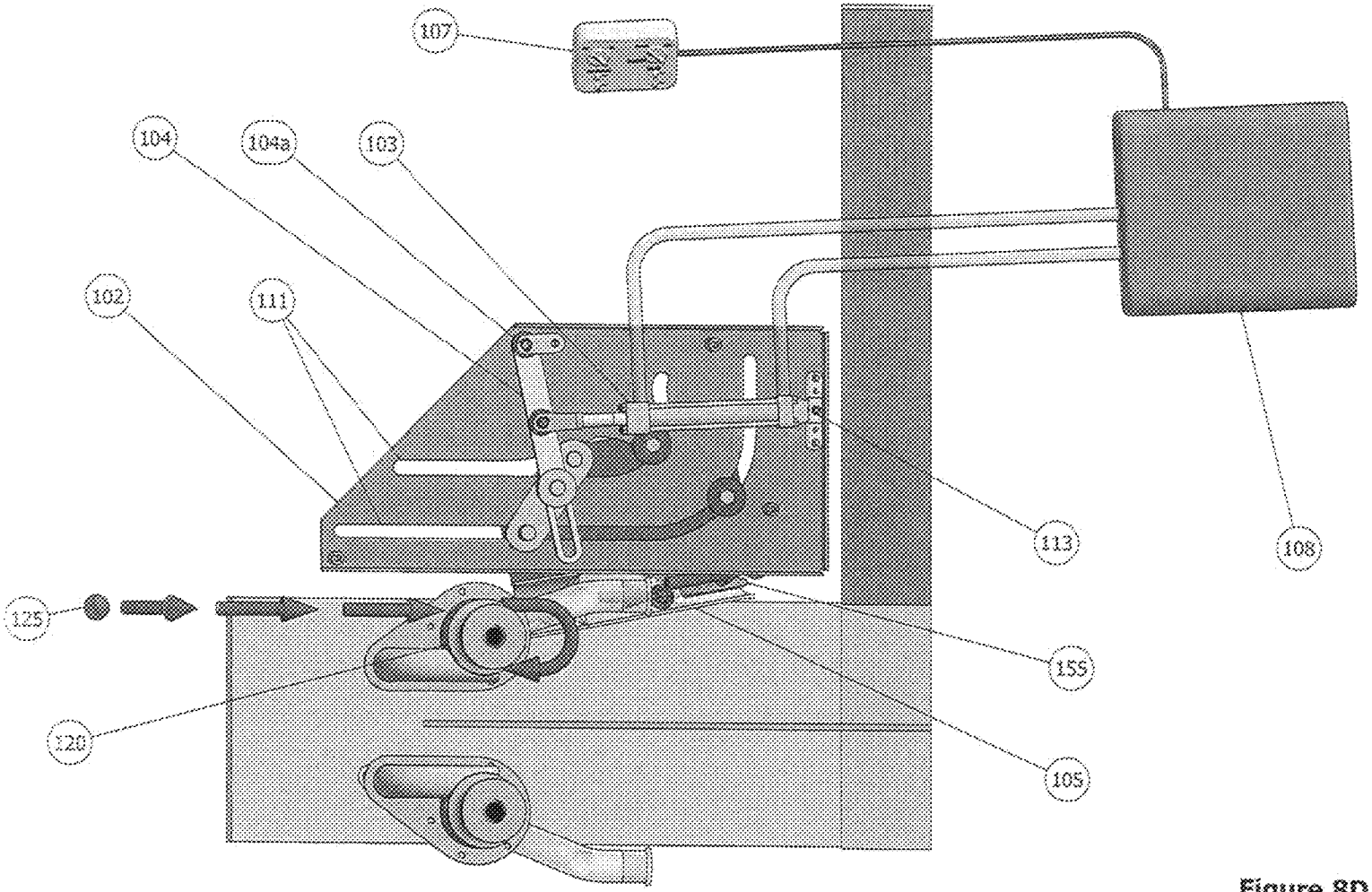
Figure 8E:
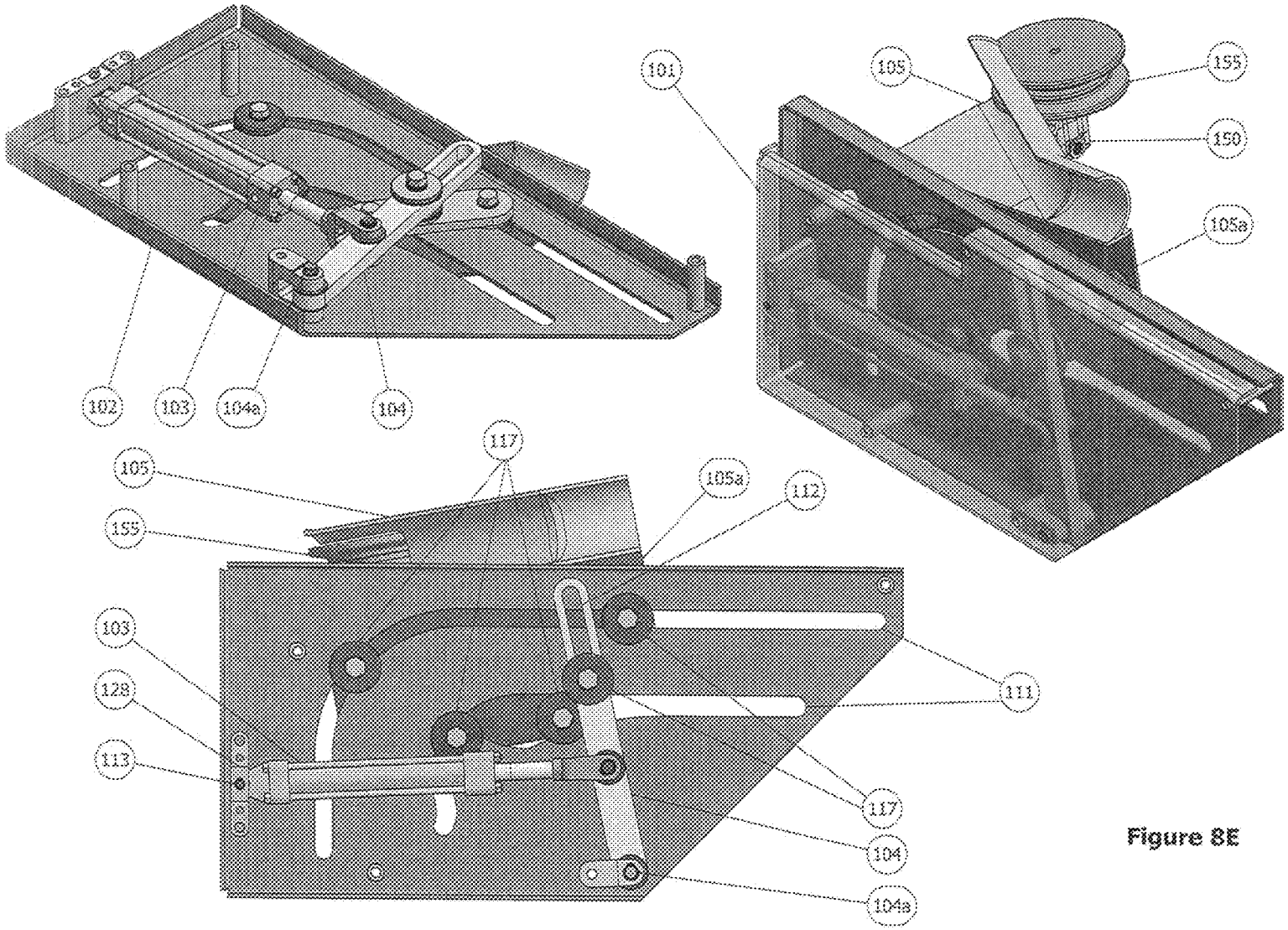
Figure 8F:
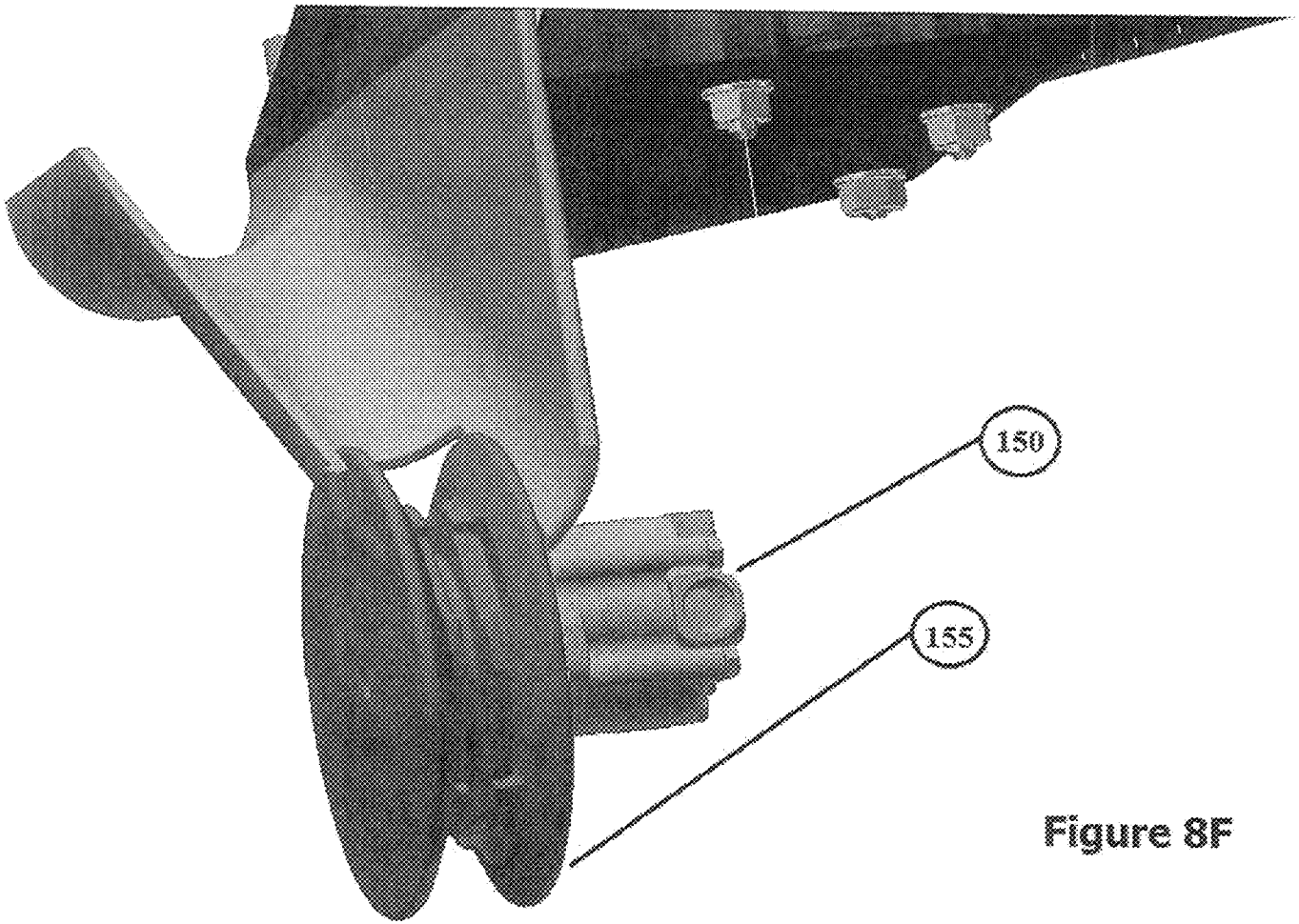

The chain roller (155) may have a surface which engages the chain that is shaped to grip the chain and advance the chain. The surface may simply define a groove so that the surface would grip the chain purely by friction, wedging within the groove. A stripper or similar device may optionally be utilized to ensure the chain is released. Another method is to use a chain gypsy as shown in FIG. 8F. As shown, the chain-engaging surface may be formed with cutouts having a shape which mates with the alternating orthogonal links of the chain. The links of the chain are gripped within the chain gypsy and driven out the end of the chain flaker fall-tube (105).

The chain may be retrieved at different speeds by the windlass. Thus, in embodiments, the rotary speed of the hydraulic motor (150) may be set so that the angular velocity of the outer perimeter runs equal to or slightly greater than the fastest linear velocity of the chain. The pressure driving the motor may be set just high enough to maintain slight tension on the chain whenever the motor is engaged. Excess flow once the set tension is reached may be diverted via the pressure reducing valve and/or relief valve. If the chain roller motor (150) is an electrical motor, a slipping clutch may be used when the tension in the chain becomes large.

In embodiments, the chain roller (155) may have an outer diameter of 8" and a width of 2.5". The diameter and/or width of the chain roller (155) may be greater or lesser than this in further embodiments. In embodiments, the outer diameter of the chain roller (155) may extend approximately 1¼" above the surface of the chain flaker fall-tube (105), though it may extend above the fall-tube (105) more or less than this in further embodiments. In embodiments, the chain roller (155) may be formed of Delrin® or for example type 316 stainless steel, though it may be formed of other materials in further embodiments.

The embodiments illustrated in FIGS. 8A-8E include a single power assist assembly near the end of the chain flaker fall-tube (105). However, it is understood that multiple power assist assemblies as described above may be included, for example at one or more of the other locations of the chain flaker assembly where the chain is made to turn.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A chain flaker assembly for receiving a chain from a spurling pipe, comprising:

a chain flaker fall-tube;

at least one of an arm and a plate having a portion on which the chain flaker fall-tube is mounted;

a mechanical drive for driving the portion of the arm or plate to undergo a cyclical stroke comprising at least one of a rotation and translation to move the chain flaker fall-tube;

wherein the chain flaker fall-tube receives the chain from the spurling pipe at least during a first portion of the stroke.

2. The chain flaker assembly of claim 1, wherein the mechanical drive comprises a track plate having at least one slot, and the portion of the plate or arm is affixed to one or more bearings, movement of the portion of the plate or arm driven through the cylindrical stroke defined by movement of the one or more bearings riding in the at least one slot.

3. The chain flaker assembly of claim 2, wherein the at least one slot comprise a pair of substantially "L"-shaped slots.

4. The chain flaker assembly of claim 3, wherein the one or more bearings comprise four bearings riding in the pair of slots.

5. The chain flaker assembly of claim 1, the cyclical stroke of the portion of the arm or plate moving the chain flaker fall-tube in a substantially "L"-shaped pattern.

6. The chain flaker assembly of claim 1, the cyclical stroke of the portion of the arm or plate moving the chain flaker fall-tube in a substantially figure-eight-shaped pattern.

7. The chain flaker assembly of claim 1, wherein the chain flaker fall-tube receives the chain from the spurling pipe during a first portion of the stroke and the chain falls from the spurling pipe without contacting the chain flaker fall-tube during a second portion of the stroke.

8. A chain flaker assembly for receiving a chain from a spurling pipe, comprising:

a chain flaker fall-tube;

a mechanical drive for driving the chain flaker fall-tube to undergo a cyclical stroke comprising at least one of a rotation and translation;

wherein the stroke is configured by the mechanical drive for the chain flaker fall-tube to receive the chain from the spurling pipe at least during a first portion of the stroke, the chain flaker fall-tube distributing the chain in a chain locker in controllable and varied target positions in the chain locker.

9. The chain flaker assembly of claim 8, wherein the stroke and the chain flaker fall-tube are configured to cyclically alter a position of the chain leaving the chain flaker fall-tube during the first portion of the stroke.

10. The chain flaker assembly of claim 8, wherein the mechanical drive comprises:

a track plate comprising at least one slot, the chain flaker fall-tube mounted to bearings riding in the at least one slot;

a hydraulic drive for cycling the bearings to move back and forth within the at one slot.

11. The chain flaker assembly of claim 10, wherein the at least one slot comprise a pair of substantially "L"-shaped slots.

12. The chain flaker assembly of claim 11, wherein the one or more bearings comprise four bearings riding in the pair of slots.

13. The chain flaker assembly of claim 8, wherein the chain flaker assembly can be removed without having to disconnect a bitter end of the chain, and without having to thread the chain out and then reverse to reinstall.

14. A chain flaker assembly for receiving a chain from a spurling pipe, comprising:

a chain flaker fall-tube;

a mechanical drive for driving the chain flaker fall-tube to undergo a cyclical stroke comprising at least one of a rotation and translation;

wherein the stroke is configured by the mechanical drive for the chain flaker fall-tube to receive the chain from the spurling pipe during at least a first portion of the stroke, the chain flaker fall-tube distributing the chain in a chain locker in controllable and varied target positions in the chain locker; and a power assist assembly for pulling the chain through the chain flaker fall-tube.

15. The chain flaker assembly of claim 14, wherein the power assist assembly comprises a chain roller and a motor driving the chain roller.

16. The chain flaker assembly of claim 14, wherein the chain roller comprises a chain-engaging surface, the chain engaging surface formed with cutouts having a shape which mates with the alternating orthogonal links of the chain.

17. The chain flaker assembly of claim 14, wherein the stroke and the chain flaker fall-tube are configured to cyclically alter a position of the chain leaving the chain flaker fall-tube during the first portion of the stroke.

18. A method of distributing a chain in a chain locker, comprising the steps of:

(a) driving a chain flaker fall-tube through a cyclical motion comprising at least one of a rotation and translation using a mechanical drive;

(b) positioning the chain flaker fall-tube and controlling the cyclical motion so that, during a first portion of the cyclical motion, the chain flaker fall-tube is clear of a path of the chain as it falls from a spurling pipe; and (c) engaging the chain with the chain flaker during a second portion of the cyclical motion so that the chain is distributed in varied positions within the chain locker during the second portion of the cyclical motion.

19. The method of claim 18, said step (a) of driving a chain flaker fall-tube through a cyclical motion comprises the step of driving the chain flaker fall-tube along a path comprising at least one of translation and rotation.

20. The method of claim 18, said step (a) of driving a chain flaker fall-tube through a cyclical motion comprises the step of driving the chain flaker fall-tube along a substantially "L"-shaped path comprising translation and rotation.

21. The method of claim 18, said step (a) of driving a chain flaker fall-tube comprises the step of driving the chain flaker fall-tube using a drive plate comprising a pair of substantially "L" slots, the chain flaker fall-tube mounted to bearings riding in the pair of slots.

* * * * *